US008789512B2

(12) United States Patent
Akagi et al.

(10) Patent No.: US 8,789,512 B2
(45) Date of Patent: Jul. 29, 2014

(54) FLUID PRESSURE REGULATING DEVICE AND FUEL SUPPLY SYSTEM USING SAME

(75) Inventors: Masaki Akagi, Okazaki (JP); Hiromasa Suzuki, Toyota (JP); Hideaki Nishibu, Tokai (JP); Koji Yoshida, Kasugai (JP); Yuichi Murakoshi, Inazawa (JP)

(73) Assignees: Toyota Jidosha Kabushiki Kaisha, Aichi-ken (JP); Aisan Kogyo Kabushiki Kaisha, Aichi-ken (JP)

( * ) Notice: Subject to any disclaimer, the term of this patent is extended or adjusted under 35 U.S.C. 154(b) by 669 days.

(21) Appl. No.: 13/150,459

(22) Filed: Jun. 1, 2011

(65) Prior Publication Data

US 2011/0297126 A1 Dec. 8, 2011

(30) Foreign Application Priority Data

Jun. 2, 2010 (JP) ..... 2010-126966

(51) Int. Cl.
*F02M 69/54* (2006.01)
*F02M 37/00* (2006.01)

(52) U.S. Cl.
CPC ..... *F02M 69/54* (2013.01); *F02M 37/0029* (2013.01); *F02M 37/0052* (2013.01); *F02M 37/0058* (2013.01); *F02D 2250/31* (2013.01)
USPC ..... 123/457; 123/510; 123/446; 123/506; 123/511; 123/514; 137/505

(58) Field of Classification Search
CPC ... F02M 51/02; F02M 69/20; F02M 37/0029; F02M 69/54; F02M 37/0058; G05D 16/18; G05D 16/0655; G05D 16/0658; F02D 2250/02; F02D 33/006; F02D 2200/0602; F02D 2250/31
USPC ..... 123/457, 459, 446, 463, 510, 511, 512, 123/514, 467; 137/14, 505, 505.11, 505.12; 251/331
See application file for complete search history.

(56) References Cited

U.S. PATENT DOCUMENTS 4,872,435 A * 10/1989 Ueyama et al. ..... 123/336
5,727,529 A * 3/1998 Tuckey ..... 123/514
7,188,610 B2 * 3/2007 Crary et al. ..... 123/457
7,717,091 B2 * 5/2010 Aoki et al. ..... 123/511

(Continued)

FOREIGN PATENT DOCUMENTS

JP 2002-310025 A 10/2002
JP 2007-218222 A 8/2007

(Continued)

*Primary Examiner* — Hai Huynh
*Assistant Examiner* — Raza Najmuddin
(74) *Attorney, Agent, or Firm* — Sughrue Mion, PLLC

(57) ABSTRACT

A fluid pressure regulating device is i) provided with a pressure regulating member that forms a pressure regulating chamber inside a housing having introduction side and discharge side fuel passages, and communicates these passages according to introduced fuel pressure, and ii) is able to regulate the fuel pressure introduced into a fuel passage to a set pressure. The housing is provided with outer and inner annular valve seat portions that separate the fuel passages inside the pressure regulating chamber, and form another fuel passage inside the pressure regulating chamber. Different clearances are set between the pressure regulating member, and the outer annular valve seat portion and the inner annular valve seat portion, such that when the pressure regulating member abuts against one of the valve seat portions, a small gap is formed between the other valve seat portion and the pressure regulating member.

11 Claims, 18 Drawing Sheets

(56) References Cited

U.S. PATENT DOCUMENTS

| | | | | |
|---|---|---|---|---|
| 7,878,179 | B2 * | 2/2011 | Ikeya | 123/457 |
| 2011/0139127 | A1 * | 6/2011 | Ikeya | 123/506 |
| 2012/0312395 | A1 * | 12/2012 | Suzuki et al. | 137/505 |

FOREIGN PATENT DOCUMENTS

| | | | |
|---|---|---|---|
| JP | 2009-108684 | A | 5/2009 |
| JP | 2011127468 | | 6/2011 |
| WO | 2011/099055 | A1 | 8/2011 |

* cited by examiner

FLUID PRESSURE REGULATING DEVICE AND FUEL SUPPLY SYSTEM USING SAME

INCORPORATION BY REFERENCE

The disclosure of Japanese Patent Application No. 2010-126966 filed on Jun. 2, 2010 including the specification, drawings and abstract is incorporated herein by reference in its entirety.

BACKGROUND OF THE INVENTION

1. Field of the Invention

The invention relates to a fluid pressure regulating device and a fuel supply system that uses this fluid pressure regulating device. More particularly, the invention relates to a fluid pressure regulating device suited to regulating fuel pressure when supplying fuel for an internal combustion engine from a fuel pump to a fuel injection valve.

2. Description of Related Art

A fuel supply system of an internal combustion engine mounted in a vehicle or the like typically supplies fuel from a fuel pump to an injector (i.e., a fuel injection valve), and regulates the fuel pressure inside a fuel supply passage using a pressure regulator, i.e., a fluid pressure regulating device. In this kind of fuel supply system, the housing of the pressure regulator is divided by a diaphragm into a pressure regulating chamber and a back pressure chamber. Urging force in a valve opening direction is applied to the diaphragm from fuel pressure inside the pressure regulating chamber, while urging force in the valve closing direction is applied to the diaphragm from the back pressure chamber side. The fuel supply system regulates the fuel pressure inside the pressure regulating chamber to a predetermined set pressure that is based on the urging force from the back pressure chamber side, by discharging some of the fuel inside the pressure regulating chamber according to the displacement of the diaphragm.

Japanese Patent Application Publication No. 2009-108684 (JP-A-2009-108684) describes one such fluid pressure regulating device and fuel supply system. This described device includes first and second diaphragms that divide the inside of a housing into three pressure chambers, a valve body that is attached to the first diaphragm so as to open and close a pressure regulating discharge outlet inside a first pressure chamber between the housing and the first diaphragm, a pressure receiving body that is connected to the valve body via a connecting passage arranged in a second pressure chamber between the first and second diaphragms, and is fixed to the second diaphragm, and a spring that is provided in a third pressure chamber between the housing and the second diaphragm and that urges the pressure receiving body in a valve closing direction. In this device, the regulated fuel pressure can be switched in a plurality of stages by controlling the supply pressure to the second and third pressure chambers.

Also, Japanese Patent Application Publication No. 2002-310025 (JP-A-2002-310025) describes a device that feeds fluid that has been regulated to an assist pressure value by a second pressure regulator into a back pressure chamber of a first pressure regulator, so as to assist the urging force of urging means of the first pressure regulator, thereby increasing the set pressure. As a result, the set pressure value is able to be increased without replacing an urging member or pressure regulator.

Furthermore, Japanese Patent Application Publication No. 2007-218222 (JP-A-2007-218222) describes a device that has an electromagnetic valve that functions as a cut-off valve provided in a return line of a back pressure chamber that introduces fluid for back pressure. When it is determined that fuel vapor may be produced, pressure on the back pressure chamber side of the pressure regulator is increased to increase the fuel supply pressure to the injector to a level that suppresses the production of fuel vapor. As a result, idle speed is prevented from becoming unstable due to the production of fuel vapor when the engine is restarted at a high temperature.

However, with a fluid pressure regulating device provided with a plunger and a second diaphragm on the back pressure chamber side, and a fuel supply system that uses such a fluid pressure regulating device, the inside of the housing of the pressure regulator is divided into first to third pressure chambers that are adjacent to each other in the displacement direction of the diaphragm. As a result, it is difficult to make the device compact, which in turn makes the device difficult to install. Also, each of the first to third pressure chambers requires a fluid inlet and a fluid outlet, so the passage configuration becomes extremely complex.

Also, with a fluid pressure regulating device in which fluid pressure is introduced to the back pressure chamber side in the housing, and a fuel supply system that uses such a fuel pressure regulating device, fluid pressure is also necessary at places other than the pressure regulating chamber when the pressure is regulated to a high pressure. As a result, extra fuel is necessary, and a greater number of portions need to be sealed, which leads to an increase in cost.

Moreover, with a fuel supply system in which an electromagnetic valve is provided in a return line for returning excess fuel that has passed through the fuel gallery from the pressure regulator to the fuel tank, the section of the fuel passage in which the pressure is increased to a high pressure during engine startup becomes wide, and a seal that can withstand the high pressure over that entire area is necessary, which leads to an increase in the cost of the fluid pressure regulating device and the fuel supply system.

SUMMARY OF THE INVENTION

The invention thus provides a low cost fluid pressure regulating device that is suitable for switching a set pressure, and in which a passage configuration is able to be simplified, thus enabling the fluid pressure regulating device to be compact, as well as a low cost fuel supply system that uses this fluid pressure regulating device, and is compact due to a simple passage configuration.

A first aspect of the invention relates to a fluid pressure regulating device that i) includes a housing having a fluid introduction side fluid passage into which fluid is introduced and a fluid discharge side fluid passage from which the fluid is discharged, and a partition wall-shaped pressure regulating member that forms a pressure regulating chamber inside the housing, the pressure regulating chamber being communicated with the fluid introduction side fluid passage, and that communicates the fluid introduction side fluid passage with the fluid discharge side fluid passage according to a pressure of the fluid introduced into the pressure regulating chamber, and that ii) is able to regulate the pressure of the fluid introduced into the fluid introduction side fluid passage to a set pressure that has been set beforehand. This fluid pressure regulating device includes a first valve seat portion and a second valve seat portion that are provided in the housing, the first valve seat portion and the second valve seat portion separating the fluid introduction side fluid passage from the fluid discharge side fluid passage in the pressure regulating chamber, and forming another fluid passage inside the pressure regulating chamber, the other fluid passage being switched between being communicated with the fluid introduction side fluid passage and being communicated with the fluid discharge side fluid passage, by the pressure regulating member. A clearance between the pressure regulating member and the first valve seat portion is set different from a clearance between the pressure regulating member and the second valve seat portion, such that when the pressure regulating member abuts against one valve seat portion, from among the first valve seat portion and the second valve seat portion, a small gap is formed between the other valve seat portion, from among the first valve seat portion and the second valve seat portion, and the pressure regulating member.

According to this structure, the pressure regulating member that constantly receives urging force in the valve closing direction from an urging mechanism changes the communication state between the fluid introduction side fluid passage and the fluid discharge side fluid passage according to the fluid pressure applied in the valve opening direction inside the pressure regulating chamber. As a result, the pressure of the fuel introduced into the fluid introduction side fluid passage is regulated to a preset set pressure. Further, the other fluid passage can be used for the introduction and/or discharge of fluid, so the set pressure can be switched between the high pressure side and the low pressure side by changing the pressure receiving area of the pressure regulating member, which is accomplished by changing the fluid passage that introduces the fluid, or by changing the fluid pressure inside the other fluid passage in conjunction with the fluid introduction side fluid passage. Moreover, the set pressure can be switched to a plurality of set pressures by controlling the inflow and outflow of fluid with only one side of the pressure regulating member. Therefore, the fluid pressure regulating device is a device that is suitable for switching the set pressure, and in which the passage configuration can be simplified, thus enabling it to be compact and inexpensive. Furthermore, the first valve seat portion and the second valve seat portion are able to be easily produced, while the required seal performance at the one valve seat portion that separates the fluid introduction side fluid passage from the fluid discharge side fluid passage can be stably ensured. Thus, a fuel supply system capable of stably regulating fluid pressure and maintaining that pressure regulating value is able to be provided.

A second aspect of the invention relates to a fuel supply system. This fuel supply system includes the fluid pressure regulating device according to the first aspect of the invention. In this fuel supply system, a pressure of fuel supplied from a fuel pump to a fuel injection valve of an internal combustion engine is regulated by the fluid pressure regulating device.

According to this structure, the set pressure can be switched to one of a plurality of set pressures by controlling the inflow and outflow of fuel with only one side of the pressure regulating member, so a low cost fuel supply system that is suitable for switching the set pressure, and that is compact due to having a simple passage configuration, can be formed. Moreover, the first valve seat portion and the second valve seat portion are able to be easily produced, while the required seal performance at the one valve seat portion that separates the fuel introduction side fluid passage from the fuel discharge side fluid passage is stably ensured. Thus, a fuel supply system capable of stably regulating fluid pressure and maintaining that pressure regulating value is able to be provided.

According to the fluid pressure regulating device according to the first example embodiment, the pressure receiving area of the pressure regulating member is changed by controlling the inflow and outflow of fluid with only one side of the pressure regulating member. Also, the housing is provided with the first valve seat portion and the second valve seat portion that have different clearances with respect to the pressure regulating member to ensure the sealability at the one valve seat portion that separates the fluid introduction side fluid passage from the fluid discharge side fluid passage. As a result, a low cost fluid pressure regulating device that is capable of stably regulating fluid pressure and maintaining that pressure regulating value, and that is suitable for switching a set pressure, and that is compact due to a simple passage configuration, can be provided.

The second aspect of the invention makes it possible to provide a low cost fuel supply system that, owing to the fluid pressure regulating device of the invention, enables the fuel pressure to be stably regulated and the regulated pressure value to be maintained, and that is suitable for switching a set pressure, and that is compact due to having a simple passage configuration.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, example embodiments of the invention will be described with reference to the accompanying drawings.

(First Example Embodiment)

FIGS. 1 to 4 are views of a fluid pressure regulating device and a fuel supply system that uses this fluid pressure regulating device, according to a first example embodiment of the invention.

This example embodiment is an example embodiment in which the invention has been applied to a fluid pressure regulating device that regulates the pressure of fuel in an internal combustion engine for a vehicle, and a fuel supply system that uses this fluid pressure regulating device, and is configured as a so-called in-tank type fuel supply system. That is, although the specific tank structure is not shown, the fuel supply system of this example embodiment includes a pressure regulator housed in a sub tank inside a fuel tank, and delivers fuel of an amount equal to the fuel consumption amount, i.e., the amount of fuel successively consumed by the engine, into the sub tank by a jet pump, for example.

First, the structure of this example embodiment will be described.

Figure 2:
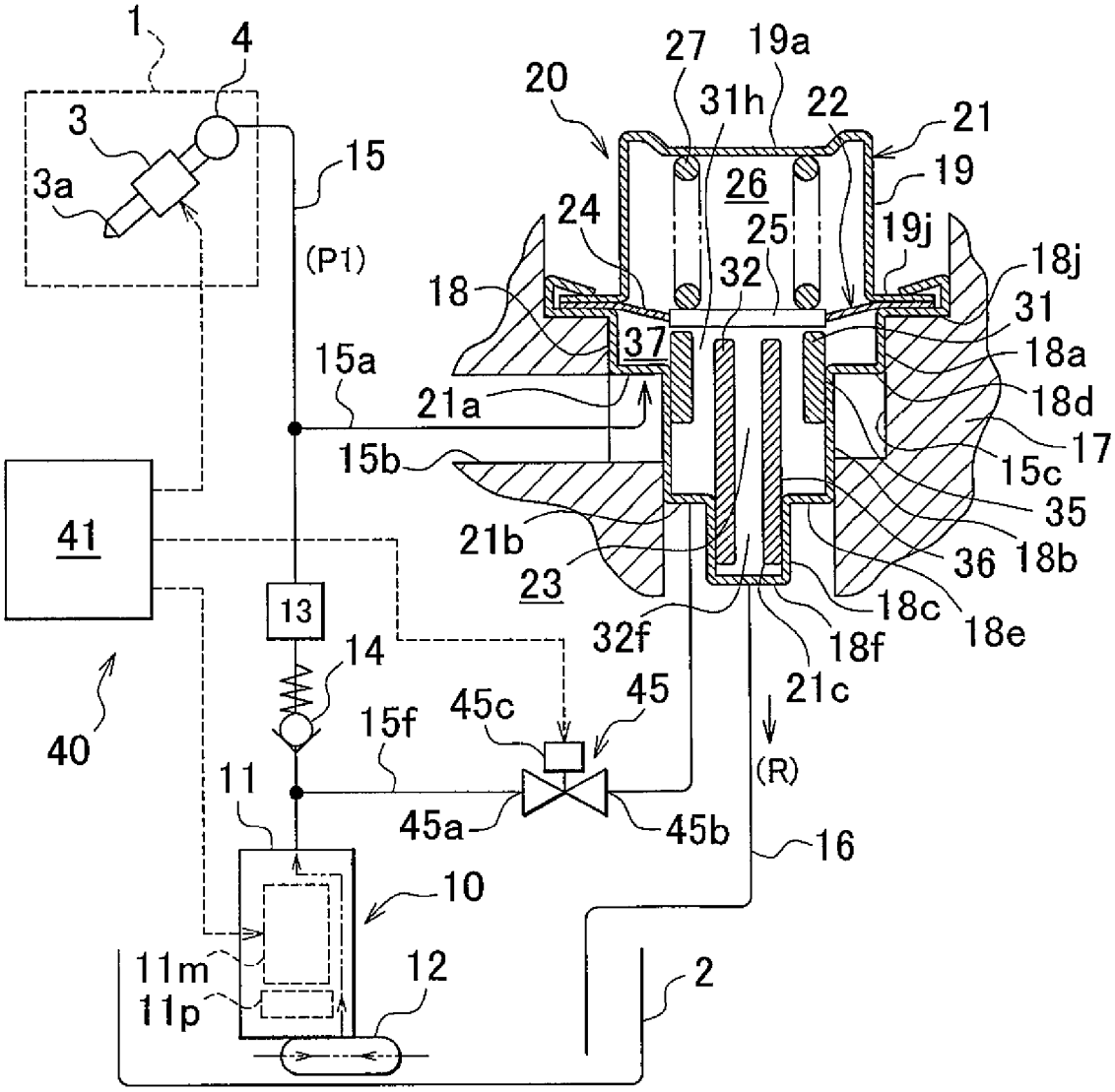
FIG. 2 is an overall block diagram of a fuel supply system according to the first example embodiment of the invention.

As shown in FIG. 2, the fuel supply system of this example embodiment includes a fuel tank 2, a fuel delivery circuit 10, a pressure regulator 20, and a set pressure switching mechanism 40. The fuel tank 2 stores fuel, such as gasoline, that is to be consumed by an engine 1 (i.e., a fuel consuming portion) that is an internal combustion engine. The fuel delivery circuit 10 delivers (i.e., pumps or pressure-feeds) and supplies the fuel that is stored in the fuel tank 2 to a plurality of injectors 3 (i.e., fuel injection valves; only one is shown in FIG. 2) provided in the engine 1. The pressure regulator 20 introduces the fuel to be supplied to the injectors 3 from the fuel delivery circuit 10, and regulates the pressure of that fuel to a fuel pressure P1 that is a preset pressure at which fuel is to be supplied to the injectors (i.e., the system pressure). The pressure regulator 20 is also able to variably control this fuel pressure P1, i.e., switch the fuel pressure P1 appropriately between a set pressure on a high pressure side and a set pressure on a low pressure side (hereinafter also simply referred to as "high set pressure" and "low set pressure"). The set pressure switching mechanism 40 is able to control the switching of the set pressure of the pressure regulator 20 to the set pressure on one of the sides, i.e., the high pressure side or the low pressure side, as appropriate.

The engine 1 is a four cycle gasoline engine with multiple cylinders, for example. The injectors 3 that are provided for the plurality of cylinders of the engine 1 are installed such that a nozzle hole side end portion 3*a* of each injector 3 is exposed inside an intake port, not shown, in each of the plurality of cylinders, for example. Also, the fuel from the fuel delivery circuit 10 is distributed to each injector 3 via a delivery pipe 4.

The fuel delivery circuit 10 includes a fuel pump 11 that draws up fuel from within the fuel tank 2 and pressurizes and discharges this fuel, a suction filter 12 that prevents foreign matter from being sucked up on the intake side of the fuel pump 11, a fuel filter 13 that removes foreign matter in the discharged fuel on the outlet side of the fuel pump 11, and a check valve 14 positioned on the upstream side of the fuel filter 13.

Although not shown in detail, the fuel pump 11 has a pump operating portion 11*p* that has an impeller for pump operation, and a direct current (DC) internal motor 11*m* that drives the pump operating portion 11*p*. This fuel pump 11 is able to draw up, pressurize, and discharge the fuel from inside the fuel tank 2, as shown by the virtual line in FIG. 2. The fuel pump 11 is able to variably control the discharge amount per unit time by changing the rotation speed [rpm] of the internal motor 11*m*. Also, the check valve 14 prevents backflow of the pressurized supplied fuel by opening in the direction in which fuel is supplied from the fuel pump 11 toward the injector 3 side, and closing in the direction in which fuel would flow back from the injector 3 side toward the fuel pump 11 side.

Also, the fuel pump 11 is driven and stopped, and thus changes the amount of fuel discharged per unit time, by an electronic control unit (hereinafter referred to as "ECU") 41 that will be described later controlling the power to the internal motor 11*m*.

Figure 1:
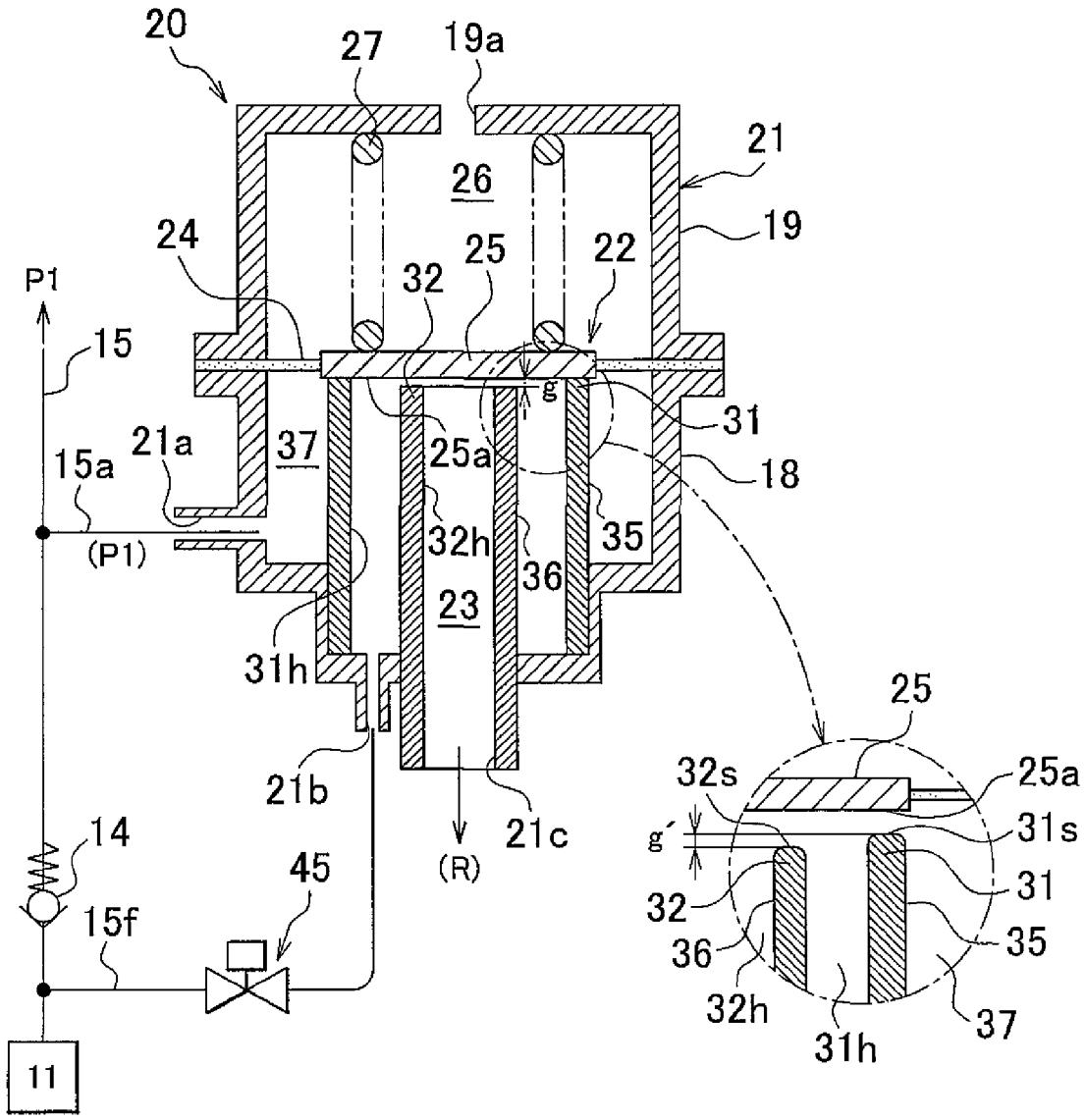
FIG. 1 is a block diagram schematically showing a fluid pressure regulating device according to a first example embodiment of the invention.

As shown in FIGS. 1 and 2, the pressure regulator 20 is provided with a housing 21 that has an outside communication hole 21*a* into which fuel is introduced, an inside communication hole 21*c* from which that fuel is discharged, and a middle communication hole 21*b* that is positioned in between the outside communication hole 21*a* and the inside communication hole 21*c* in the radial direction. With this housing 21, a pair of concave shaped housing members 18 and 19 are connected together by crimping at outer peripheral flange portions 18*j* and 19*j*, respectively. Incidentally, the communication holes 21*a* and 21*b* are each provided in plurality and separated at equidistant intervals in the circumferential direction of the housing 21, but it is sufficient to have at least one formed somewhere in the circumferential direction of the housing 21, and the shapes of the openings of these communication holes is arbitrary. Also, the housing members 18 and 19 are each made of steel sheet or stainless steel sheet that has been press formed into concave shape, and but they may also be formed in the shapes shown in the drawings.

As shown in FIGS. 1 and 2, a partition wall-shaped pressure regulating member 22 that divides the inside of the housing 21 into two chambers is provided inside the housing 21. The pressure regulating member 22 forms a pressure regulating chamber 23 that is inside the housing 21 and between the housing 21 and the pressure regulating member 22, and that is communicated with the outside communication hole 21*a*.

This pressure regulating member 22 is formed by a flexible annular membrane member 24 and a plate-shaped member 25 that is generally disc-shaped (i.e., a plate-shaped movable valve body portion) and that is positioned on the inner peripheral side of the annular membrane member 24, integrally assembled together. The annular membrane member 24 constantly receives the pressure of the fuel introduced into the pressure regulating chamber 23 from the outside communication hole 21*a* on one side of the annular membrane member 24 (this will be described in detail later). Also, the pressure regulating member 22 forms a back pressure chamber 26 between it (i.e., the pressure regulating member 22) and the housing 21 on the other side. A compression coil spring 27 (i.e., an elastic member), that serves as an urging mechanism that urges the plate-shaped member 25 of the pressure regulating member 22 in the valve closing direction, is provided inside this back pressure chamber 26. Also, at least one atmospheric pressure introducing hole 19*a* is formed in one of the housing members 19 that, together with the pressure regulating member 22, forms the back pressure chamber 26. The pressure regulating member 22 is displaced in the valve opening direction that communicates the outside communication hole 21*a* with the inside communication hole 21*c*, against the urging force in the valve closing direction from the compression coil spring 27, according to the fuel pressure introduced into the pressure regulating chamber 23.

The annular membrane member 24 of the pressure regulating member 22 is specifically formed by a flexible diaphragm in which a rubber layer (such as hydrogenated nitrile rubber or fluoro-rubber or the like) that is not easily deteriorated by fuel is integrally bonded to a base fabric material layer (such as a polyamide synthetic fiber), for example. The plate-shaped member 25 of the pressure regulating member 22 is formed by a generally disc-shaped plate made of metal (such as tool steel or stainless steel or the like), for example, that is supported at the center portion of the annular membrane member 24.

Further, a large diameter outer annular valve seat portion 31 (i.e., a first valve seat portion) and a small diameter inner annular valve seat portion 32 (i.e., a second valve seat portion) that face one side of the plate-shaped member 25 of the pressure regulating member 22 inside the pressure regulating chamber 23 are arranged substantially concentric inside the housing 21. The outer annular valve seat portion 31 and the inner annular valve seat portion 32 and the plate-shaped member 25 form a pressure regulating valve mechanism that opens and closes by relative displacement.

More specifically, the outer annular valve seat portion 31 and the inner annular valve seat portion 32 are formed by an outer cylindrical member 35 and an inner cylindrical member 36, respectively, that have different diameters and that are arranged on the same axis inside the housing 21. The outer cylindrical member 35 that corresponds to the outer annular valve seat portion 31 forms a middle fuel passage 31*h* (another fluid passage) that is communicated with the middle communication hole 21*b*, between it (i.e., the outer cylindrical member 35) and the inner cylindrical member 36, on the inner peripheral side of the outer cylindrical member 35, and forms an annular outer fuel passage 37 (i.e., a fluid introduction side fluid passage) that is communicated with the outside communication hole 21*a*, between it (i.e., the outer cylindrical member 35) and the housing 21 and the pressure regulating member 22, on the outer peripheral side of the outer cylindrical member 35. Further, an inner fuel passage 32*h* (i.e., a fluid discharge side fluid passage) is formed on the inner peripheral side of the inner annular valve seat portion 32. This inner fuel passage 32*h* opens into the fuel tank 2 through the inside communication hole 21*c*. Incidentally, the inner and outer peripheral edge portions of the outer annular valve seat portion 31 and the inner annular valve seat portion 32, respectively, are chamfered.

The outer annular valve seat portion 31 and the inner annular valve seat portion 32 separate the outer fuel passage 37 that is the fluid introduction side fluid passage from the inner fuel passage 32*h* that is the fluid discharge side fluid passage inside the pressure regulating chamber 23, as well as form the middle fuel passage 31*h* (i.e., another fluid passage) in the pressure regulating chamber 23. This middle fuel passage 31*h* is switched between being communicated with the outer fuel passage 37 and being communicated with the inner fuel passage 32*h*, by the pressure regulating member 22, for example. That is, the outer annular valve seat portion 31 forms the outer fuel passage 37 that is the fluid introduction side fluid passage, and separates this outer fuel passage 37 from the middle fuel passage 31*h*. The inner annular valve seat portion 32 forms the inner fuel passage 32*h*, and also forms the middle fuel passage 31*h* that is the other fluid passage between it (i.e., the inner annular valve seat portion 32) and the outer annular valve seat portion 31.

Also, the plate-shaped member 25 has a valve surface portion 25*a* (i.e., one side surface) that cuts off communication between the outer fuel passage 37 and the middle fuel passage 31*h* when seated on the outer annular valve seat portion 31. The outer annular valve seat portion 31 and the inner annular valve seat portion 32 have valve seat surfaces 31*s* and 32*s*, respectively, that are both parallel to the valve surface portion 25*a* of the plate-shaped member 25.

In this way, in this example embodiment, the outer fuel passage 37, the middle fuel passage 31*h*, and the inner fuel passage 32*h* are each arranged on one side of the pressure regulating member 22. The pressure regulating member 22 opens and closes communication between the outer fuel passage 37, and the middle fuel passage 31*h* and the inner fuel passage 32*h*, according to i) the urging force in the valve opening direction (i.e., the direction that communicates the outer fuel passage 37 with the middle fuel passage 31*h* and the inner fuel passage 32*h*) based on the pressure of the fuel introduced into the outer fuel passage 37 inside the housing 21, as well as based on the pilot pressure selectively introduced into the middle fuel passage 31*h*, and ii) the urging force in the valve closing direction (i.e., the direction that closes off communication between the outer fuel passage 37, and the middle fuel passage 31*h* and the inner fuel passage 32*h*) from the compression coil spring 27.

Figure 3A:
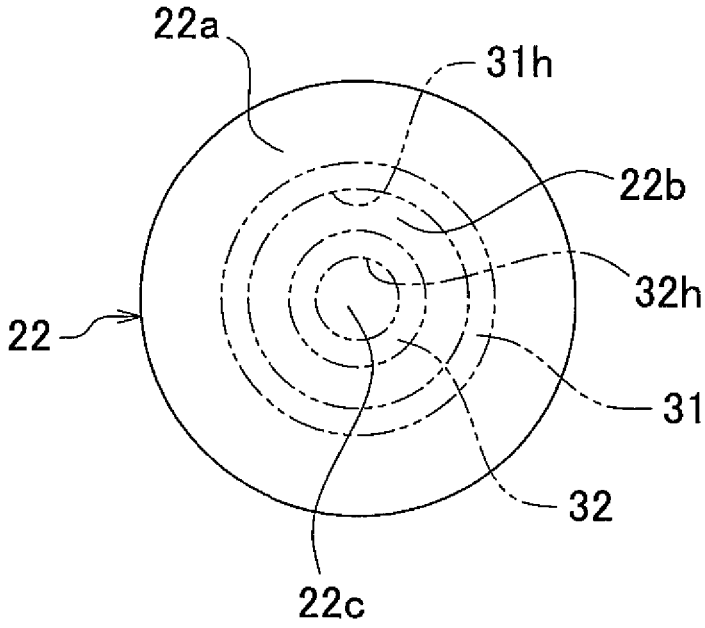
FIG. 3A is a plan view of one side of a pressure regulating member of the fluid pressure regulating device according to the first example embodiment of the invention.
Figure 3B:
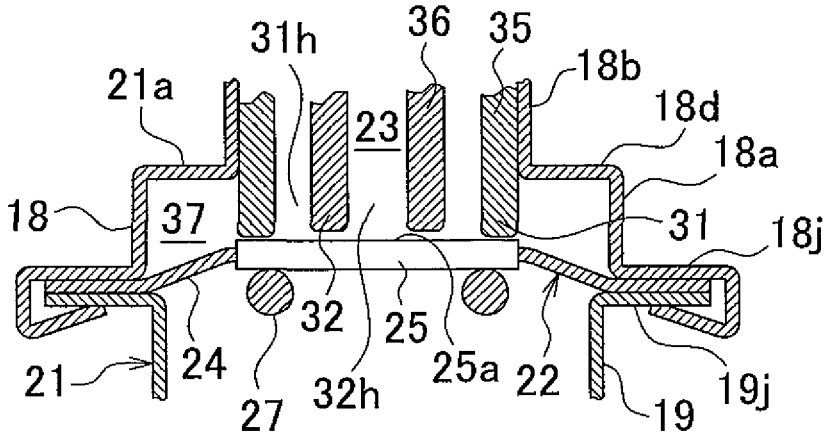
FIG. 3B is an enlarged sectional view of the area near the pressure regulating member of the fluid pressure regulating device.
Figure 4:
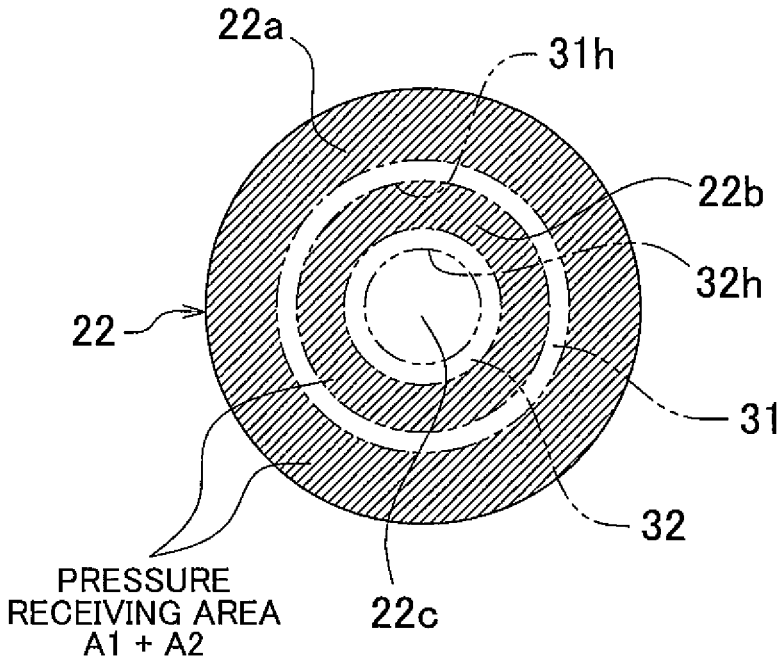
FIG. 4 is a view of the arrangement of pressure receiving regions of the pressure regulating member of the fluid pressure regulating device according to the first example embodiment of the invention.

Meanwhile, as shown in FIGS. 1 and 3B, the outer annular valve seat portion 31 and the inner annular valve seat portion 32 are such that a clearance between the pressure regulating member 22 and the outer annular valve seat portion 31 is set different from a clearance between the pressure regulating member 22 and the inner annular valve seat portion 32, such that when the outer annular valve seat portion 31, i.e., one valve seat portion, abuts against the valve surface portion 25*a* of the plate-shaped member 25 of the pressure regulating member 22 (i.e., when the pressure regulating member 22 is seated on the outer annular valve seat portion 31), there is a small annular gap g between the inner annular valve seat portion 32, i.e., the other valve seat portion, and the plate-shaped member 25 of the pressure regulating member 22. In other words, the valve seat surface 31*s* of the outer annular valve seat portion 31 and the valve seat surface 32*s* of the inner annular valve seat portion 32 form a step g' that corresponds to the small gap g in the axial direction of the outer cylindrical member 35 and the inner cylindrical member 36, that is the displacement direction of the plate-shaped member 25 of the pressure regulating member 22. Incidentally, the clearance in this case refers to a small gap (i.e., a separation distance between opposing surfaces) that is equal to or greater than zero, with respect to the valve surface portion 25*a* of the plate-shaped member 25, on the outer annular valve seat portion 31 side, and greater than zero, with respect to the valve surface portion 25*a* of the plate-shaped member 25, on the inner annular valve seat portion 32 side.

Therefore, in this example embodiment, switching the middle fuel passage 31*h* between being communicated with the outer fuel passage 37 and being communicated with the inner fuel passage 32*h*, by the pressure regulating member 22, refers to switching the middle fuel passage 31*h* between a state in which it is communicated with the outer fuel passage 37 and a state in which it is cut off from the outer fuel passage 37, by the pressure regulating member 22, and switching the middle fuel passage 31*h* between a state in which it is communicated with the inner fuel passage 32*h* and a state in which that communication is restricted to a throttled amount that corresponds to the small gap g, by the pressure regulating member 22. That is, the switching of the communication state of the other fluid passage in the invention includes not only switching between a state in which communication is open to the fluid introduction side fluid passage and the fluid discharge side fluid passage and a state in which communication from both of these fluid passages is cut off, but also switching between restricting and not restricting communication to these fluid passages, or between a large communication passage sectional area and a small communication passage sectional area (i.e., between a strong and weak restriction) when communication to both fluid passages is restricted.

Also, as shown in FIG. 3A, the pressure regulating member 22 includes an outer annular surface portion 22*a* that receives the pressure of fluid introduced into the outer fuel passage 37, a middle annular surface portion 22*b* that receives the pressure of fluid selectively introduced to the middle fuel passage 31*h*, and a circular center surface portion 22*c* that faces the inner end portion of the inner fuel passage 32*h*.

The outer annular surface portion 22*a* of the pressure regulating member 22 is formed at the periphery of the plate-shaped member 25 by the annular membrane member 24 that is connected, in a fluid-tight (air-tight) manner, to the outer peripheral portion of the plate-shaped member 25 and is supported by the housing 21. This outer annular surface portion 22*a* constantly receives the fuel pressure inside the annular outer fuel passage 37. Also, the middle annular surface portion 22*b* of the pressure regulating member 22 is formed by the valve surface portion 25*a* on the side of the plate-shaped member 25 that faces the pressure regulating chamber 23. This middle annular surface portion 22*b* receives the fuel pressure inside the middle fuel passage 31*h*. The circular center surface portion 22*c* receives pressure corresponding to the internal pressure (e.g., atmospheric pressure) of the fuel tank 2 inside the inner fuel passage 32*h*, so this circular center surface portion 22*c* is essentially not pressurized. Also, the outer annular surface portion 22*a* and the middle annular surface portion 22*b* of the pressure regulating member 22 are adjacent to each other in the radial direction with a border portion (not denoted by a reference character) that corresponds to the outer annular valve seat portion 31 in between. Also, the middle annular surface portion 22*b* and the circular center surface portion 22*c* of the pressure regulating member 22 are adjacent to each other in the radial direction with a border portion (also not denoted by a reference character) that corresponds to the inner annular valve seat portion 32 in between.

Also, when the pressure of pressurized fuel from the fuel pump 11 is applied to the outer annular surface portion 22*a* of the pressure regulating member 22, the pressure regulating member 22 regulates the pressure of fuel on the supply side that is introduced into the outer fuel passage 37 to a set pressure by opening and closing communication between the outer fuel passage 37 and the middle fuel passage 31*h*.

Also, the pressure of pressurized fuel from the fuel pump 11 is selectively applied to the middle annular surface portion 22*b* of the pressure regulating member 22 as pilot pressure. The pressure regulating member 22 changes the set pressure according to the fuel pressure (i.e., the pilot pressure) inside the middle fuel passage 31*h* that is applied to this middle annular surface portion 22*b*. Here, a pressure receiving area A1 of the outer annular surface portion 22*a* and a pressure receiving area A2 of the middle annular surface portion 22*b* on the inside are set such that the area ratio A1/A2 becomes a preset area ratio.

As shown in FIGS. 2 and 3B, the other housing member 18 of the housing 21 is formed in a stepped concave shape with a plurality of steps so as to become deeper toward the inside in the radial direction. The outer cylindrical member 35 and the inner cylindrical member 36 that form the outer annular valve seat portion 31 and the inner annular valve seat portion 32 are fixed to the housing member 18 at different radial positions. Also, the housing member 18 of the housing 21 more specifically has a first annular wall portion 18*a* that is away, toward the outside in the radial direction, from the outer cylindrical member 35, a second annular wall portion 18*b* that supports the outer cylindrical member 35, and a third annular wall portion 18*c* that supports the inner cylindrical member 36. In addition, the housing member 18 also has a first stepped wall portion 18*d* that connects the first annular wall portion 18*a* with the second annular wall portion 18*b*, a second stepped wall portion 18*e* that connects the second annular wall portion 18*b* with the third annular wall portion 18*c*, and a third stepped wall portion 18*f* that is connected to the outer end portion of the third annular wall portion 18*c*.

The outside communication hole 21*a* formed in the housing 21 is open in the first stepped wall portion 18*d* of the housing member 18 at an outer peripheral surface side (i.e., the radial outside) of the outer cylindrical member 35. The middle communication hole 21*b* for introducing pilot pressure fuel that is formed in the housing 21 is open in the second stepped wall portion 18*e* at an inner peripheral surface side (i.e., the radial inside) of the outer cylindrical member 35.

The outer fuel passage 37 is formed by the housing member 18, the annular membrane member 24 of the pressure regulating member 22, and the outer cylindrical member 35. This outer fuel passage 37 introduces fuel from the outside communication hole 21 a, and makes the outer annular surface portion 22*a* receive that fuel pressure. Also, the middle fuel passage 31*h* is formed in a generally cylindrical shape between the outer cylindrical member 35 and the inner cylindrical member 36, and is communicated with the middle communication hole 21*b* of the housing 21. Furthermore, the inner fuel passage 32*h* is formed in a generally circular columnar shape inside of the inner cylindrical member 36. The inside communication hole 21*c* that is communicated with the inner fuel passage 32*h* is formed in the third stepped wall portion 18*f* of the housing member 18.

As shown in FIG. 2, the outside communication hole 21*a* is connected to a branch passage 15*a* (i.e., a supply side branch passage) of a fuel passage 15 that is a circuit portion downstream of the check valve 14 of the fuel delivery circuit 10. The middle communication hole 21 b is connected to a branch passage 15*f* that is a circuit portion upstream of the check valve 14 of the fuel delivery circuit 10. Here, the branch passage 15*a* of the fuel passage 15 forms a fuel line portion between the delivery pipe 4 and the check valve 14, and includes a branch portion 15*b* and an annular passage portion 15*c*. The branch portion 15*b* is formed in a portion 17 (only a portion is shown in FIG. 2) of a filter case that houses filter elements, not shown, of the suction filter 12 and the fuel filter 13, for example, along with the fuel pump 11. The annular passage portion 15*c* is formed between this portion 17 of the filter case and the housing 21. Also, the branch passage 15*f* is a fuel line that introduces fuel delivered from the fuel pump 11, from one end side that is upstream of the check valve 14. The other end side of this branch passage 15*f* is communicated with the middle fuel passage 31*h* through the middle communication hole 21*b*.

Also, an electromagnetic valve 45 (i.e., a set pressure switching valve) is provided in the branch passage 15*f* that is an upstream side circuit portion of the fuel passage 15.

This electromagnetic valve 45 has a first port 45*a*, a second port 45*b*, and an electromagnetic operating portion 45*c*. The first port 45*a* is connected to an upstream portion of the branch passage 15*f* of the fuel passage 15, and introduces pressurized fuel. The second port 45*b* is connected to a downstream portion of the branch passage 15*a* of the fuel passage 15, and introduces pressurized fuel into the middle fuel passage 31*h* when communicated with the first port 45*a*. The electromagnetic operating portion 45*c* switches the communication state between these two ports 45*a* and 45*b*.

Also, the electromagnetic operating portion 45*c* closes off the second port 45*b* from the first port 45*a* when turned on in response to receiving excitation driving current supplied from the ECU 41 side, and opens the second port 45*b* to the first port 45*a* when turned off in response to receiving no excitation driving current from the ECU 41 side.

This electromagnetic valve 45 switches the region where the pressure of the pressurized fuel is applied to the pressure regulating member 22 to only the outer annular surface portion 22*a* of the pressure receiving area A1 or to both the outer annular surface portion 22*a* of the pressure receiving area A1 and the middle annular surface portion 22*b* of the pressure receiving area A2, by changing the fuel pressure inside the middle fuel passage 31*h* that is applied to the middle annular surface portion 22*b* of the pressure regulating member 22, which is accomplished by selectively restricting the inflow (i.e., the introduction) of pilot pressure fuel into the middle fuel passage 31*h*. That is, the electromagnetic valve 45 switches the set pressure of the pressure regulator 20 (i.e., the set value of the fuel pressure to be regulated) to either a set pressure on a high pressure side (i.e., a high set pressure) or a set pressure on a low pressure side (i.e., a low set pressure).

Here, the high set pressure and the low set pressure of the pressure regulator 20 have a pressure ratio that corresponds to an area ratio of the pressure receiving area A1 when the pressure receiving region of the pressure regulating member 22 is only the outer annular surface portion 22*a*, to a pressure receiving area (A1+A2) when the pressure receiving region of the pressure regulating member 22 is both the outer annular surface portion 22*a* of the pressure receiving area A 1 and the middle annular surface portion 22*b* of the pressure receiving area A2. The ratio of the low set pressure to the high set pressure corresponds the ratio (A1/(A1+A2)) of the pressure receiving area A1 of the outer annular surface portion 22*a* to the sum of the pressure receiving areas of both of the pressure receiving surface portions 22*a* and 22*b* (i.e., A1+A2).

Also, the pressure regulator 20 is configured to switch between a low set pressure that corresponds to a fuel supply pressure during normal operation of the engine 1, for example, and a high set pressure that corresponds to a fuel pressure that is maintained within a residual pressure maintaining section, that will be described later, when the engine 1 is stopped, such as during an idling stop, for example.

The term "residual pressure maintaining section" in this case is a passage section of the fuel passage 15 that is formed upstream of the injectors 3 and downstream of the check valve 14, and that maintains the fuel pressure by urging force from the compression coil spring 27 via the pressure regulating member 22 while being communicated with the outer fuel passage 37. Also, the high set pressure is a set pressure when the region where fuel pressure is applied to the pressure regulating member 22 is only the outer annular surface portion 22*a* that corresponds to the outer fuel passage 37. In this example embodiment, this high set pressure is a set pressure when the fuel pressure within a downstream passage section from the check valve 14 to the injectors 3 is received by the outer annular surface portion 22*a* while the engine 1 and the fuel pump 11 are stopped. Moreover, the high set pressure is a set pressure when fuel starts to be supplied from the fuel pump 11 to the injectors 3 to start the engine 1, and when generating high pressure within the residual pressure maintaining section during high load operation.

Incidentally, the high set pressure is 400 [kPa] (gauge pressure; hereinafter the same), for example, and is the set value of a fuel pressure at which fuel vapor is not easily produced (normally, 324 kPa or higher) even if the fuel temperature within the delivery pipe 4 is high immediately after the engine is stopped or the like. Also, the low set pressure is 240 [kPa], for example, and is the set value of a fuel pressure at which fuel vapor is not easily produced even if the fuel temperature inside the delivery pipe 4 is relatively low while the engine 1 is running.

The ECU 41 includes, for example, a CPU (Central Processing Unit), ROM (Read Only Memory), RAM (Random Access Memory), and backup memory made up of nonvolatile memory, as well as an input interface circuit and an output interface circuit, and the like. This ECU 41 receives ON/OFF signals from an ignition switch of the vehicle, and is supplied with power from a battery. Furthermore, a variety of sensors are connected to the input interface circuit of the ECU 41. Sensor information from these sensors is received by the ECU 41 via the input interface circuit that includes an AID converter and the like. Relay switches, switching elements, and driving circuits and the like for controlling various actuators such as the fuel pump 11 and the electromagnetic valve 45 are provided in the output interface circuit of the ECU 41.

Also, the ECU 41 regulates the fuel from the fuel pump 11 to the high set pressure inside the pressure regulating chamber 23 by switching the electromagnetic valve 45 on (i.e., to a valve closed state) just before fuel starts to be supplied to start the engine 1 and just before the engine 1 is stopped. The ECU 41 performs this switching operation based on the sensor information from the various sensors and map information and the set value stored in advance in the ROM and backup memory, by executing a control program stored in the ROM. The ECU 41 also repeatedly determines the load of the engine 1 while the engine 1 is operating, and regulates the pressure of fuel supplied from the fuel pump 11 to the injectors 3 to the low set pressure inside the pressure regulating chamber 23 by switching the electromagnetic valve 45 off in the partial load operating region that accounts for most of the operating states after startup, i.e., in the normal operating region that does not include high load operation, after startup. Therefore, the high and low set values for the fuel pressure are included in the set values stored in the ROM and the backup memory of the ECU 41. An operating region determining map and the like for determining the operating load and controlling the switch of the fuel pressure according to the determination results is included in the map information stored in the ROM and the backup memory.

The term "at startup" in this case is, specifically, when there is an ignition ON request by an ignition key being turned to a start position, for example, when the engine 1 is restarted after temporarily being stopped in a vehicle that executes a well-known idling stop, or when there is an ignition ON request to start the engine 1 at a time such as when restarting the engine 1 after it had been temporarily stopped in order to improve the power unit efficiency in a vehicle provided with a hybrid type power unit.

Next, a method for controlling the fuel pressure in the fuel supply system according to this example embodiment will be described.

With the pressure regulator 20 and the fuel supply system that uses this pressure regulator 20 according to this example embodiment structured as described above, while the engine 1 is stopped for an extended period of time, the fuel pump 11 of the fuel delivery circuit 10 is stopped so as not to supply fuel, so the discharge side fuel pressure of the fuel pump 11 is 0 [kPa (gauge)], and the electromagnetic valve 45 is off, i.e., no current is flowing to the electromagnetic operating portion 45*c*.

At this time, the electromagnetic valve 45 is in a fuel introducing position that communicates the first port 45*a* with the second port 45*b*, but because the fuel pump 11 is stopped, pressurized fuel is not supplied to the middle fuel passage 31*h* of the pressure regulator 20. Therefore, the effective pressure receiving region where the pressure regulating member 22 receives the pressure of the pressurized fuel in the valve opening direction is only the outer annular surface portion 22*a* that receives the fuel pressure inside the annular outer fuel passage 37, so the fuel pressure P1 in the residual pressure maintaining section from the check valve 14 to the injectors 3, i.e., the fuel supply pressure to the injectors 3, is equivalent to the fuel pressure in the outer fuel passage 37.

Moreover, the pressure regulating member 22 is such that the plate-shaped member 25 is made to sit on the outer annular valve seat portion 31 by the compression coil spring 27 and approaches the inner annular valve seat portion 32. Therefore, the fuel pressure P inside the outer fuel passage 37 is such that the product of the urging force P1 in the valve opening direction that is applied to the pressure regulating member 22 from the outer fuel passage 37 side multiplied by the urging force in the valve opening direction that corresponds to the pressure receiving area A1 of the outer annular surface portion 22*a* becomes an urging force that matches or is less than the urging force in the valve closing direction from the compression coil spring 27 (P1≤H). However, as will be described later, the set pressure is switched to the high set pressure H right before the fuel pump 11 stops when the engine 1 is stopped. Therefore, the fuel pressure P1 while operation of the engine 1 is stopped is a value that is higher than the low set pressure L and equal to or lower than the high set pressure H (i.e., L≤P1≤H). Incidentally, the operation when stopping the engine 1 and immediately after the engine 1 is stopped will be described later.

When the engine 1 is started, the ECU 41 first energizes the electromagnetic valve 45 before the engine 1 starts. That is, the electromagnetic valve 45 is switched on before fuel starts to be supplied to the fuel pump 11 and the discharge pressure of that fuel rises.

At this time, the electromagnetic valve 45 switches the second port 45*b* to a valve closed state that closes the second port 45*b* from the first port 45*a*. Meanwhile, the fuel pump 11 is still stopped.

Also, at this time, the fuel pressure P1 in the residual pressure maintaining section from the check valve 14 to the injectors 3 is maintained substantially the same as it has been, i.e., at a fuel pressure equal to or higher than the low set pressure L and equal to or less than the high set pressure H (i.e., L≤P1≤H).

Next, when the fuel pump 11 is started, fuel is supplied from the fuel pump 11 into the residual pressure maintaining section. At this time the electromagnetic valve 45 is in the valve closed state, so the fuel pressure inside the outer fuel passage 37 quickly reaches the high set pressure H.

That is, the fuel pressure inside the outer fuel passage 37 quickly rises until the urging force in the valve opening direction that is applied to the pressure regulating member 22 from the outer fuel passage 37 side reaches an urging force corresponding to the product of the high set pressure H that is the urging force in the valve closing direction from the compression coil spring 27 multiplied by the area A1 of the outer annular surface portion. The excess pressurized fuel is discharged to the middle fuel passage 31*h*. Incidentally, the small gap g between the valve surface portion 25*a* of the plate-shaped member 25 and the inner annular valve seat portion 32 is a size that enables the excess fuel to pass to the inner fuel passage 32*h* side without resistance when the plate-shaped member 25 of the pressure regulating member 22 is seated on, or close to being seated on, the outer annular valve seat portion 31.

Next, the engine 1 is started. At this time, high pressure fuel that has been pressurized to the high set pressure H is supplied to the injectors 3, so atomization of the fuel injected into the combustion chambers of the engine 1 from the injectors 3 is promoted. Incidentally, the same startup control described above may of course also be executed during restarting of the engine 1.

The operating state of the engine 1 after startup is normally mostly a partial load operating state, except for a specific operating state in which high fuel pressure is requested such as when there is a request for high load operation. During normal operation, the low set pressure is requested from the standpoints of fuel efficiency of the engine 1 and reliability of the fuel pump 11.

During normal operation, the ECU 41 does not energize the electromagnetic valve 45 and the fuel pump 11 continues to operate. Therefore, when the engine 1 shifts into normal operation after startup, the electromagnetic valve 45 is switched off (to the valve open state).

At this time, fuel is supplied from the fuel pump 11 to both the outer fuel passage 37 and the middle fuel passage 31*h*, so the pressure receiving region of the pressure regulating member 22 that receives the pressure of the pressurized fuel is both the outer annular surface portion 22*a* of the pressure receiving area A1 and the middle annular surface portion 22*b* of the pressure receiving area A2.

Therefore, the pressure regulating member 22 receives the urging force H×A1 in the valve closing direction from the compression coil spring 27, while receiving both the urging force P1×A1 in the valve opening direction at the outer annular surface portion 22*a* to which the fuel pressure P(=P1) inside the outer fuel passage 37 is applied, and the urging force P1×A2 in the valve opening direction at the middle annular surface portion 22*b* to which the fuel pressure P2(=P1) inside the middle fuel passage 31*h* is applied, so the pressure is regulated such that these urging forces P1 (A1+A2) balance out.

Accordingly, the fuel pressure P1 at this time is equal to H×A1/(A1+A2), which is the low set pressure L (i.e., P1 =H×A1/(A1+A2) =low set pressure L). Therefore, if the high set pressure H is 400 [kPa] and the area ratio A1/A2 of the outer annular surface portion 22*a* to the middle annular surface portion 22*b* equals 1 (i.e., A1/A2=1), the fuel pressure P1 at this time becomes a low set pressure L of 200 [kPa].

While the engine 1 is operating, the ECU 41 determines which operating region stored beforehand as map information the operating state that is requested of the engine 1 corresponds to, based on the operating state such as the speed of the engine 1 and the vehicle speed obtained from various sensor information, and an accelerator pedal operation amount by the driver, and the like. The ECU 41 then controls the power to the electromagnetic valve 45 as well as the power to the fuel pump 11, to achieve a fuel pressure suitable for the requested operating state.

During normal operation of the engine 1, pressurized fuel is supplied form the fuel pump 11 to both the outer fuel passage 37 and the middle fuel passage 31*h* of the pressure regulator 20 to achieve the low set pressure L.

When the operating state requested of the engine 1 enters a high load operating region due to operational input from the driver driving the vehicle or a change in the running environment of the vehicle, the ECU 41 switches the electromagnetic valve 45 on and continues to operate the fuel pump 11.

Immediately after this switch, the electromagnetic valve 45 closes such that pressurized fuel stops being introduced to the middle fuel passage 31*h*, and as a result, the fuel pressure inside the middle fuel passage 31*h* decreases, just like at startup of the engine 1 described above.

Meanwhile, the fuel pump 11 continues to operate, so pressurized fuel continues to be supplied to the outer fuel passage 37 of the pressure regulator 20, so the fuel pressure P1 that is the system pressure quickly rises to the high set pressure H. Accordingly, a fuel injection quantity sufficient to meet the high load demand can be ensured.

When stopping the engine 1, the ECU 41 turns the electromagnetic valve 45 on (i.e., to the valve closed state) before stopping the engine 1. For example, when there is an ignition OFF request to stop the engine 1 in response to the driver turning the ignition key to the ignition OFF side, for example, the ECU 41 first energizes the electromagnetic valve 45 to turn it on. Then when a sufficient amount of time has passed for the pressure regulating member 22 inside the pressure regulator 20 to be stably in the on position, a routine required to stop the engine 1 is executed.

Immediately after the engine 1 stops, the temperature of the fuel in the residual pressure maintaining section from the check valve 14 to the injectors 3 in the fuel supply path rises due to the fact that the engine 1 is no longer being cooled by coolant or cool air. At this time, the fuel pressure P1 in this residual pressure maintaining section is equal to the fuel pressure P within the outer fuel passage 37 of the pressure regulator 20. This fuel pressure P within the outer fuel passage 37 is in a flexibly pressurized state by the flexible annular membrane member 24 of the pressure regulating member 22 at the outer annular surface portion 22*a* so as to be able to rise to the high set pressure H. Therefore, when the temperature of the fuel in the residual pressure maintaining section from the check valve 14 to the injectors 3 increases, the vapor pressure of the fuel in the residual pressure maintaining section increases along with this temperature increase, so the fuel pressure P1 rises to maintain the vapor-liquid equilibrium. Therefore, even if the fuel temperature inside the delivery pipe 4 is high immediately after the engine stops or the like, a residual pressure at which fuel vapor is not easily produced can be effectively ensured, such that a good high temperature restart and the like is possible.

Next, the operation of this example embodiment will be described.

In the pressure regulator 20 as the fuel pressure regulating device described above and the fuel supply system that uses this pressure regulator 20, the pressure regulating member 22 that constantly receives urging force in the valve closing direction from the compression coil spring 27 changes the communication state between the outer fuel passage 37 and the inner fuel passage 32*h* according to the fluid pressure applied in the valve opening direction inside the pressure regulating chamber 23. As a result, the pressure of the fuel introduced into the outer fuel passage 37 is regulated to a preset set pressure. Further, the middle fuel passage 31*h* can be used for the introduction or discharge of fuel, so the set pressure of the pressure regulator 20 can be changed between the high pressure side and the low pressure side (i.e., the high set pressure and the low set pressure) by changing the pressure receiving area (i.e., the pressurized area) of the pressure regulating member 22, which can be accomplished by changing the fuel passage that introduces the fuel to different inside/outside positions, or by changing the fuel pressure inside the middle fuel passage 31*h* in conjunction with the fluid introduction side fuel passage.

Moreover, the pressure regulator 20 is able to switch between a plurality of set pressures, i.e., high and low, by controlling the inflow and outflow of fluid with only one side of the pressure regulating member 22. As a result, the pressure regulator 20 is a device that is suitable for switching the set pressure, and in which the passage configuration can be simplified, thus enabling it to be compact and inexpensive.

Furthermore, the outer annular valve seat portion 31 forms the outer fuel passage 37, as well as separates the outer fuel passage 37 from the inner fuel passage 32*h*. The inner annular valve seat portion 32 forms the inner fuel passage 32*h*, and forms the other middle fuel passage 31*h* between it (i.e., the inner annular valve seat portion 32) and the outer annular valve seat portion 31. The small gap g is formed between the pressure regulating member 22 and the inner annular valve seat portion 32 when the pressure regulating member 22 abuts against the outer annular valve seat portion 31. As a result, the required seal performance at the outer annular valve seat portion 31 that separates the outer fuel passage 37 from the inner fuel passage 32*h* can be stably ensured, so the fluid pressure can be regulated more stably and the pressure regulating value can be maintained.

Also, sealability is not required at the inner annular valve seat portion 32. Therefore, the housing 21 having the outer annular valve seat portion 31 and the inner annular valve seat portion 32 can be more easily manufactured compared with when the outer annular valve seat portion 31 and the inner annular valve seat portion 32 are both made to abut against the valve surface portion 25*a* of the plate-shaped member 25.

In addition, the outer annular valve seat portion 31 and the inner annular valve seat portion 32 are arranged concentrically, so the outer annular valve seat portion 31 and the inner annular valve seat portion 32 can be produced even more easily, and the operation of the pressure regulating member 22 can be stabilized. Also, the outer annular valve seat portion 31 and the inner annular valve seat portion 32 are formed by the end portions of the outer cylindrical member 35 and the inner cylindrical member 36 that are concentrically arranged, so the sectional areas and lengths of the plurality of fluid passages 37, 31*h*, and 32*h* can be set appropriately according to the shapes of the outer cylindrical member 35 and the inner cylindrical member 36. In addition, the outer annular valve seat portion 31 and the inner annular valve seat portion 32 can be easily produced on the end portions of the cylindrical members 35 and 36, so the pressure regulator 20 can be easy to manufacture and inexpensive.

Also, the pressure regulating member 22 has the plate-shaped member 25 that serves as a plate-shaped movable valve body portion that faces the outer annular valve seat portion 31 and the inner annular valve seat portion 32, and the outer annular valve seat portion 31 and the inner annular valve seat portion 32 have the valve seat surfaces 31*s* and 32*s* that are both parallel to the valve surface portion 25*a* of the plate-shaped member 25. Therefore, the sealability between the plate-shaped member 25 and the outer annular valve seat portion 31 when the valve is closed can be improved. Also, an appropriate constriction can be formed at the inner edge portion of the middle fuel passage 31*h* by appropriately setting the small gap g (i.e., clearance) between the plate-shaped member 25 and the inner annular valve seat portion 32, and the rate (i.e., speed) at which the set pressure is switched can be adjusted according to this constriction.

Furthermore, the area of the pressure receiving region of the pressure regulating member 22 is changed by changing the pressure of the fluid inside the middle fuel passage 31*h*. As a result, the pressure receiving area of the pressure regulating member 22 on one side of the pressure regulating member 22 can be easily changed, so the set pressure can be easily and reliably switched. Moreover, the electromagnetic valve 45 that selectively restricts the introduction of pressurized fuel into the middle fuel passage 31*h* and thus changes the fuel pressure in the middle fuel passage 31*h* is provided, so a simple set pressure switching mechanism that uses the electromagnetic valve 45 is able to be realized.

As described above, in this example embodiment, the set pressure is switched between a plurality of set pressures, i.e., a high set pressure and a low set pressure, by controlling the inflow and outflow of fuel with only one side of the pressure regulating member 22, which is accomplished by regulating the pressure of the fuel supplied from the fuel pump 11 to the injectors 3 of the engine 1 using the pressure regulator 20 described above. As a result, there is no longer a need for a fluid passage to the back pressure chamber 26 side, nor is it necessary to use a plurality of pressure regulators. Thus, a low cost fuel supply system that is suitable for switching the set pressure, and that is compact due to having a simple passage configuration, can be provided. Moreover, the outer annular valve seat portion 31 and the inner annular valve seat portion 32 are able to be easily produced, while the required seal performance at the outer annular valve seat portion 31 that separates the outer fuel passage 37 on the fuel introduction side from the inner fuel passage 32*h* on the fuel discharge side is stably ensured. Thus, a fuel supply system capable of stably regulating fluid pressure and maintaining that pressure regulating value is able to be provided.

(Second Example Embodiment)

Figure 5:
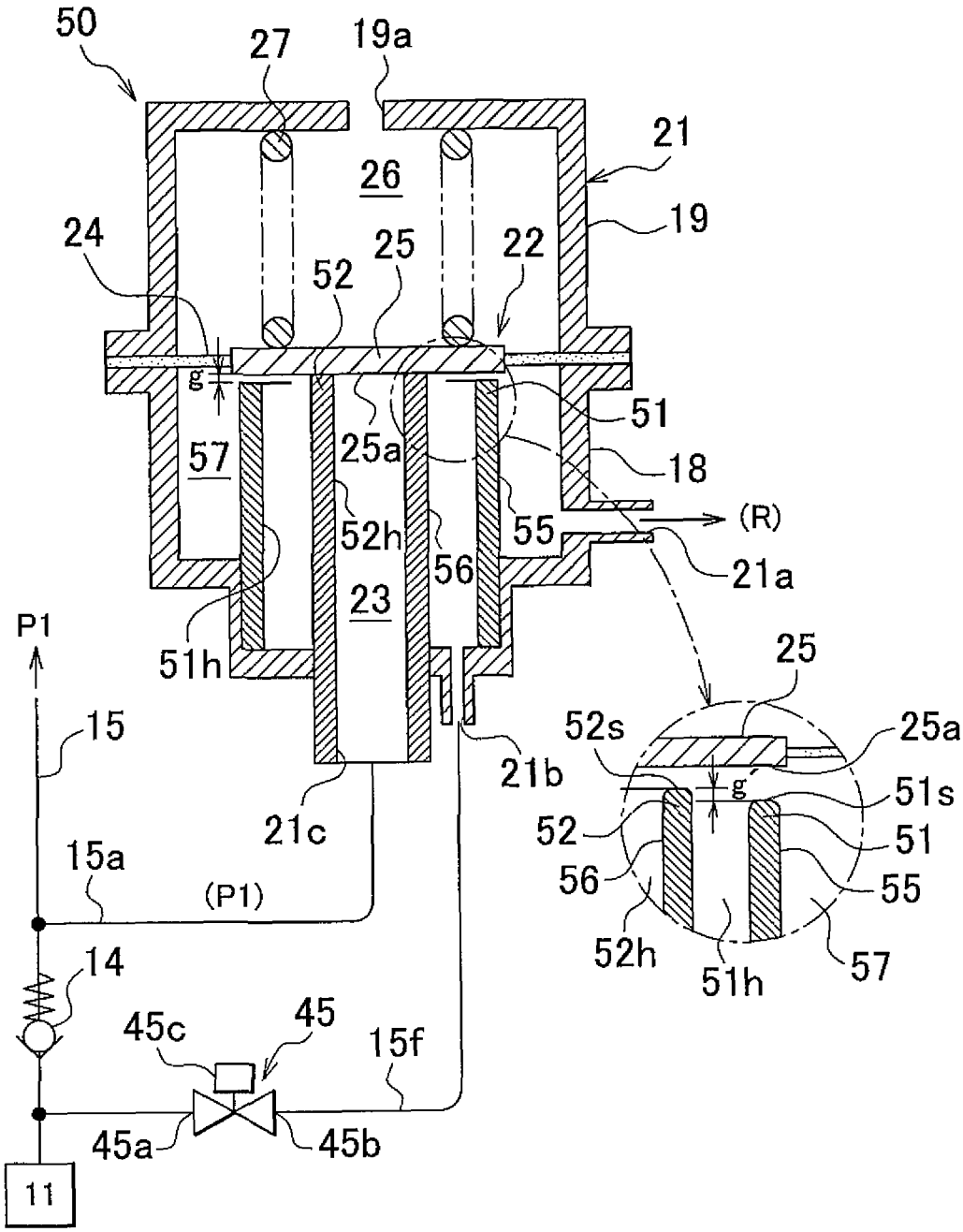
FIG. 5 is a block diagram schematically showing a fluid pressure regulating device according to a second example embodiment of the invention.

FIGS. 5 and 6 are views of a fluid pressure regulating device and a fuel supply system using this device, according to a second example embodiment of the invention.

Incidentally, the example embodiments described below have a structure similar to that of the first example embodiment described above. The constituent elements of the fuel supply system other than the pressure regulator are substantially the same as those of the first example embodiment described above, so only the main portions are shown. Constituent elements that are the same as or similar to those in the first example embodiment described above will be denoted by the same reference characters that denote the corresponding constituent elements shown in FIGS. 1 to 4, and descriptions of those constituent elements will not be repeated. That is, only the differences with respect to the first example embodiment described above will be described below.

As shown in FIG. 5, the fuel supply system of this second example embodiment is provided with a pressure regulator 50. This pressure regulator 50 includes a housing 21 that has an inside communication hole 21*c* into which pressurized fuel from a fuel pump 11 is constantly introduced when the fuel pump 11 is operating, an outside communication hole 21*a* to which fuel that has been introduced into the pressure regulating chamber 23 is discharged, and a middle communication hole 21*b* to which pressurized fuel from the fuel pump 11 is selectively introduced as pilot pressure via an electromagnetic valve 45. A pressure regulating chamber 23 is formed by this housing 21 and a partition-shaped pressure regulating member 22, just as in the first example embodiment.

Also, a large diameter outer annular valve seat portion 51 and a small diameter inner annular valve seat portion 52 that face one side of a plate-shaped member 25 of a pressure regulating member 22 are arranged substantially concentric inside the pressure regulating chamber 23. The outer annular valve seat portion 51 and the inner annular valve seat portion 52 and the pressure regulating member 22 form a pressure regulating valve mechanism that opens and closes by relative displacement.

The outer annular valve seat portion 51 and the inner annular valve seat portion 52 separate an inner fuel passage 52*h* that is a fluid introduction side fluid passage from an outer fuel passage 57 that is a fluid discharge side fluid passage, inside the pressure regulating chamber 23, as well as form a middle fuel passage 51*h* (i.e., another fluid passage) in the pressure regulating chamber 23. This middle fuel passage 51*h* is switched between being communicated with the outer fuel passage 57 and being communicated with the inner fuel passage 52*h*, by the pressure regulating member 22, for example. That is, the outer annular valve seat portion 51 (i.e., a second valve seat portion) forms the outer fuel passage 57, i.e., the fluid discharge side fluid passage, between it (i.e., the outer annular valve seat portion 51) and the housing 21, and forms the middle fuel passage 51*h* between it (i.e., the outer annular valve seat portion 51) and the inner annular valve seat portion 52 (i.e., a first valve seat portion). The inner annular valve seat portion 52 (i.e., the first valve seat portion) forms the inner fuel passage 52*h* that is an fluid introduction side fluid passage, and separates the inner fuel passage 52*h* from the outer annular valve seat portion 51 and the middle fuel passage 51*h*.

More specifically, the outer annular valve seat portion 51 and the inner annular valve seat portion 52 are formed by an outer cylindrical member 55 and an inner cylindrical member 56, respectively, that have different diameters and that are arranged on the same axis inside the housing 21. The outer cylindrical member 55 that corresponds to the outer annular valve seat portion 51 forms the middle fuel passage 51*h* (the other fluid passage) that is communicated with the middle communication hole 21*b*, between it (i.e., the outer cylindrical member 55) and the inner cylindrical member 56, on the inner peripheral side of the outer cylindrical member 55, and forms the annular outer fuel passage 57 that is communicated with the outside communication hole 21*a* on the fuel discharge side, between it (i.e., the outer cylindrical member 55) and the housing 21 and the pressure regulating member 22, on the outer peripheral side of the outer cylindrical member 55. Further, the inner fuel passage 52*h* is formed on the inner peripheral side of the inner annular valve seat portion 52. This inner fuel passage 52*h* is connected to a branch passage 15*a* (i.e., a supply side branch passage) of a fuel passage 15 that is a circuit portion downstream of a check valve 14 of a fuel delivery circuit 10. Furthermore, the outer fuel passage 57 opens into the fuel tank 2 through the outside communication hole 21*a*. The middle fuel passage 51*h* is connected to a second port 45*b* of an electromagnetic valve 45 through the middle communication hole 21*b*.

Figure 6A:
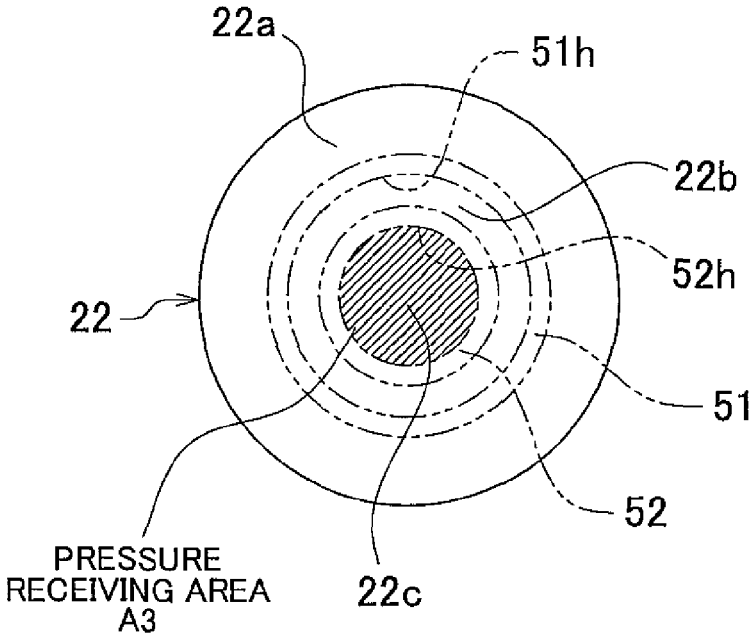
FIG. 6A is a view of the arrangement of a pressure receiving region, when a set pressure is on a high pressure side, of a pressure regulating member of the fluid pressure regulating device according to the second example embodiment of the invention.
Figure 6B:
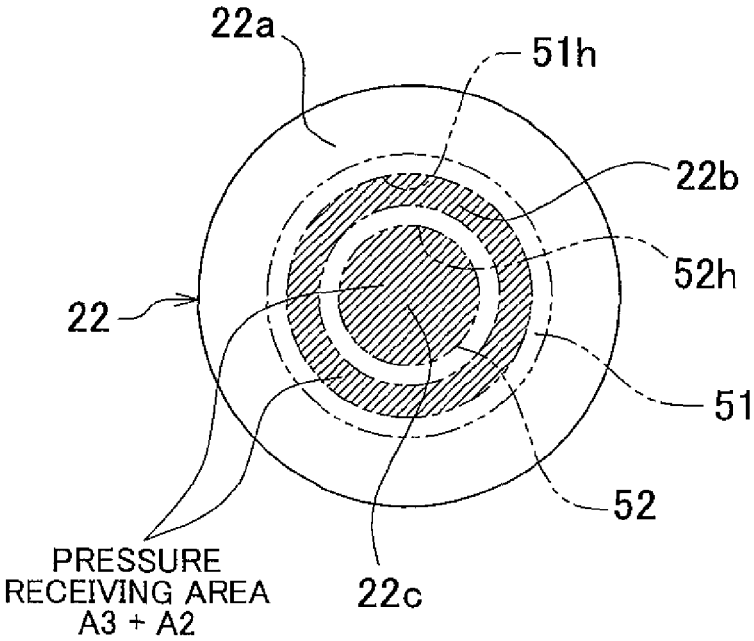
FIG. 6B is a view of an arrangement of pressure receiving regions, when a set pressure is on a low pressure side, of the pressure regulating member of the fluid pressure regulating device.

As shown in FIGS. 6A and 6B, the outer annular surface portion 22*a* of the pressure regulating member 22 receives the internal pressure (atmospheric pressure) of the fuel tank 2 that is introduced into the outer fuel passage 57, so this outer annular surface portion 22*a* is essentially not pressurized. Also, the middle annular surface portion 22*b* of the pressure regulating member 22 receives the pressure of the fuel inside the middle fuel passage 51*h*, and the circular center surface portion 22*c* of the pressure regulating member 22 constantly receives the fuel pressure inside the inner fuel passage 52*h* into which pressurized fuel is introduced while the fuel pump 11 is operating. Also, the fuel pressure inside the middle fuel passage 51*h* changes depending on whether the electromagnetic valve 45 is on or off, i.e., depending on whether the pressure of the pressurized fuel from the fuel pump 11 is introduced as pilot pressure.

The electromagnetic valve 45 switches the region where the pressure of the pressurized fuel is applied to the pressure regulating member 22 to only the circular center surface portion 22*c* of a pressure receiving area A3 or to both the circular center surface portion 22*c* of the pressure receiving area A3 and the middle annular surface portion 22*b* of the pressure receiving area A2, by changing the fuel pressure inside the middle fuel passage 51*h* that is applied to the middle annular surface portion 22*b* of the pressure regulating member 22, which is accomplished by selectively restricting the inflow of pilot pressure fuel into the middle fuel passage 51*h*. Then the pressure regulating member 22 is able to switch the set pressure of the pressure regulator 50 by changing the substantive pressure receiving area of the pressure regulating member 22 according to the pressure of the fuel inside the middle fuel passage 51*h* that is applied to the middle annular surface portion 22*b* (i.e., according to the pilot pressure). Here, the pressure receiving area A3 of the inner fuel passage 52*h* and the pressure receiving area A2 of the middle annular surface portion 22*b* on the inside are set such that the area ratio A3/A2 becomes a preset area ratio.

The plate-shaped member 25 (a movable valve body portion) closes off communication between the inner fuel passage 52*h*, and the middle fuel passage 51*h* and the outer fuel passage 57, when a valve surface portion 25*a* (one side portion) is seated on the inner annular valve seat portion 52. The outer annular valve seat portion 51 and the inner annular valve seat portion 52 have valve seat surfaces 51*s* and 52*s*, respectively, that are both parallel to the valve surface portion 25*a* of the plate-shaped member 25. Also, when the pressure of the pressurized fuel from the fuel pump 11 is applied to at least the circular center surface portion 22*c*, from among the circular center surface portion 22*c* and the middle annular surface portion 22*b* of the pressure regulating member 22, the pressure regulator 50 is able to regulate the pressure of the fuel on the supply side that is introduced into the inner fuel passage 52*h* to a set pressure by the pressure regulating member 22 opening and closing communication between the inner fuel passage 52*h*, and the middle fuel passage 51*h* and the outer fuel passage 57.

In this way, in this example embodiment, the outer fuel passage 57, the middle fuel passage 51*h*, and the inner fuel passage 52*h* are each arranged on one side of the pressure regulating member 22. The pressure regulating member 22 opens and closes communication between the inner fuel passage 52*h*, and the middle fuel passage 51*h* and the outer fuel passage 57, according to i) the urging force in the valve opening direction (i.e., the direction that communicates the inner fuel passage 52*h* with the middle fuel passage 51*h* and the outer fuel passage 57) based on the pressure of the fuel introduced into the inner fuel passage 52*h* inside the housing 21, as well as based on the pilot pressure selectively introduced into the middle fuel passage 51*h*, and ii) the urging force in the valve closing direction (i.e., the direction that closes off communication between the inner fuel passage 52*h*, and the middle fuel passage 51*h* and the outer fuel passage 57) from the compression coil spring 27.

Meanwhile, the outer annular valve seat portion 51 and the inner annular valve seat portion 52 are such that a clearance between the pressure regulating member 22 and the outer annular valve seat portion 51 is set different from a clearance between the pressure regulating member 22 and the inner annular valve seat portion 52, such that when the inner annular valve seat portion 52 that is one of the valve seat portions abuts against the valve surface portion 25*a* of the plate-shaped member 25 of the pressure regulating member 22 (i.e., when the pressure regulating member 22 is seated on the inner annular valve seat portion 52), there is a small annular gap g between the outer annular valve seat portion 51 that is the other valve seat portion, and the plate-shaped member 25 of the pressure regulating member 22. In other words, the valve seat surface 51*s* of the outer annular valve seat portion 51 and the valve seat surface 52*s* of the inner annular valve seat portion 52 form a step g' that corresponds to the small gap g in the axial direction of the outer cylindrical member 55 and the inner cylindrical member 56, that is the displacement direction of the plate-shaped member 25 of the pressure regulating member 22.

In the fuel supply system of the example embodiment structured as described above, when the electromagnetic valve 45 is on (i.e., in the valve closed state), fuel is supplied from the fuel pump 11 to only the inner fuel passage 52*h*, of the inner fuel passage 52*h* and the middle fuel passage 51*h*, so the pressure receiving region of the pressure regulating member 22 that receives the pressure of the pressurized fuel is only the circular center surface portion 22*c* of the pressure receiving area A3, as shown in FIG. 6A. Therefore, if the high set pressure is H [kPa], the pressure regulating member 22 receives the urging force H×A3 in the valve closing direction from the compression coil spring 27, while receiving the urging force P1×A3 in the valve opening direction at the circular center surface portion 22*c* to which the fuel pressure P1 inside the inner fuel passage 52*h* is applied, so the pressure is regulated such that the urging force H×A3 in the valve closing direction from the compression coil spring 27 and the urging force P1×A3 in the valve opening direction that is based on the fuel pressure inside the pressure regulating chamber 23 balance out. As a result, the fuel pressure P1 at this time becomes the high set pressure H.

On the other hand, when the electromagnetic valve 45 is off (i.e., in the valve open state), fuel is supplied from the fuel pump 11 to both the inner fuel passage 52*h* and the middle fuel passage 51*h*, so the pressure receiving region of the pressure regulating member 22 that receives the pressure of the pressurized fuel is both the circular center surface portion 22*c* of the pressure receiving area A3 and the middle annular surface portion 22*b* of the pressure receiving area A2, as shown in FIG. 6B. Therefore, when the high set pressure is H [kPa], the pressure regulating member 22 receives the urging force H×A3 in the valve closing direction from the compression coil spring 27, while receiving both the urging force P1×A3 in the valve opening direction at the circular center surface portion 22*c* to which the fuel pressure P1 inside the inner fuel passage 52*h* is applied, and the urging force P1×A2 in the valve opening direction at the middle annular surface portion 22*b* to which the fuel pressure P2(=P1) inside the middle fuel passage 51*h* is applied, so the pressure is regulated such that the urging force H×A3 in the valve closing direction from the compression coil spring 27 and the urging force P1 (A3+A2) in the valve opening direction that is based on the fuel pressure inside the pressure regulating chamber 23 balance out. Accordingly, the fuel pressure P1 at this time is equal to H×A3/(A3+A2), which is the low set pressure L (i.e., P1=H×A3/(A3+A2)=low set pressure L).

Therefore, if the high set pressure H is 400 [kPa] and the area ratio A3/A2 of the outer annular surface portion 22*a* to the middle annular surface portion 22*b* equals 1 (i.e., A3/A2=1), the fuel pressure P1 when the electromagnetic valve 45 is off becomes the low set pressure L of 200 [kPa].

In the fuel supply system of the example embodiment structured as described above, the pressure regulating member 22 that constantly receives urging force in the valve closing direction from the compression coil spring 27 changes the communication state between the inner fuel passage 52*h* on the fluid introduction side and the outer fuel passage 57 on the fluid discharge side according to the fluid pressure applied in the valve opening direction inside the pressure regulating chamber 23. As a result, the pressure of the fuel introduced into the inner fuel passage 52*h* on the fluid introduction side is regulated to a preset set pressure. Further, the middle fuel passage 51*h* can be used for the introduction of pilot pressure fuel or the discharge of fuel, so the set pressure of the pressure regulator 50 can be changed between the high pressure side and the low pressure side by changing the pressure receiving area of the pressure regulating member 22, which is accomplished by introducing fuel pressure as the pilot pressure into the middle fuel passage 51*h* in conjunction with the inner fuel passage 52*h*.

Also, sealability is not required at the outer annular valve seat portion 51. Therefore, the housing 21 having the outer annular valve seat portion 51 and the inner annular valve seat portion 52 can be more easily manufactured compared with when the outer annular valve seat portion 51 and the inner annular valve seat portion 52 are both made to abut against the valve surface portion 25*a* of the plate-shaped member 25.

Furthermore, in this example embodiment, the set pressure is switched between a plurality of set pressures, i.e., a high set pressure and a low set pressure, by controlling the inflow and outflow of fuel with only one side of the pressure regulating member 22, which is accomplished by regulating the pressure of the fuel supplied from the fuel pump 11 to the injectors 3 of the engine 1 using the pressure regulator 50 described above. As a result, there is no longer a need for a fluid passage to the back pressure chamber 26 side, nor is it necessary to use a plurality of pressure regulators. Thus, a low cost fuel supply system that is suitable for switching the set pressure, and that is compact due to having a simple passage configuration, can be provided. Moreover, the outer annular valve seat portion 51 and the inner annular valve seat portion 52 are able to be easily produced, while the required seal performance at the inner annular valve seat portion 52 that separates the inner fuel passage 52*h* on the fuel introduction side from the outer fuel passage 57 on the fuel discharge side is stably ensured. Thus, a fuel supply system capable of stably regulating fluid pressure and maintaining that pressure regulating value is able to be provided. Accordingly, this example embodiment is able to yield the same effects as the first example embodiment described above.

(Third Example Embodiment)

Figure 7:
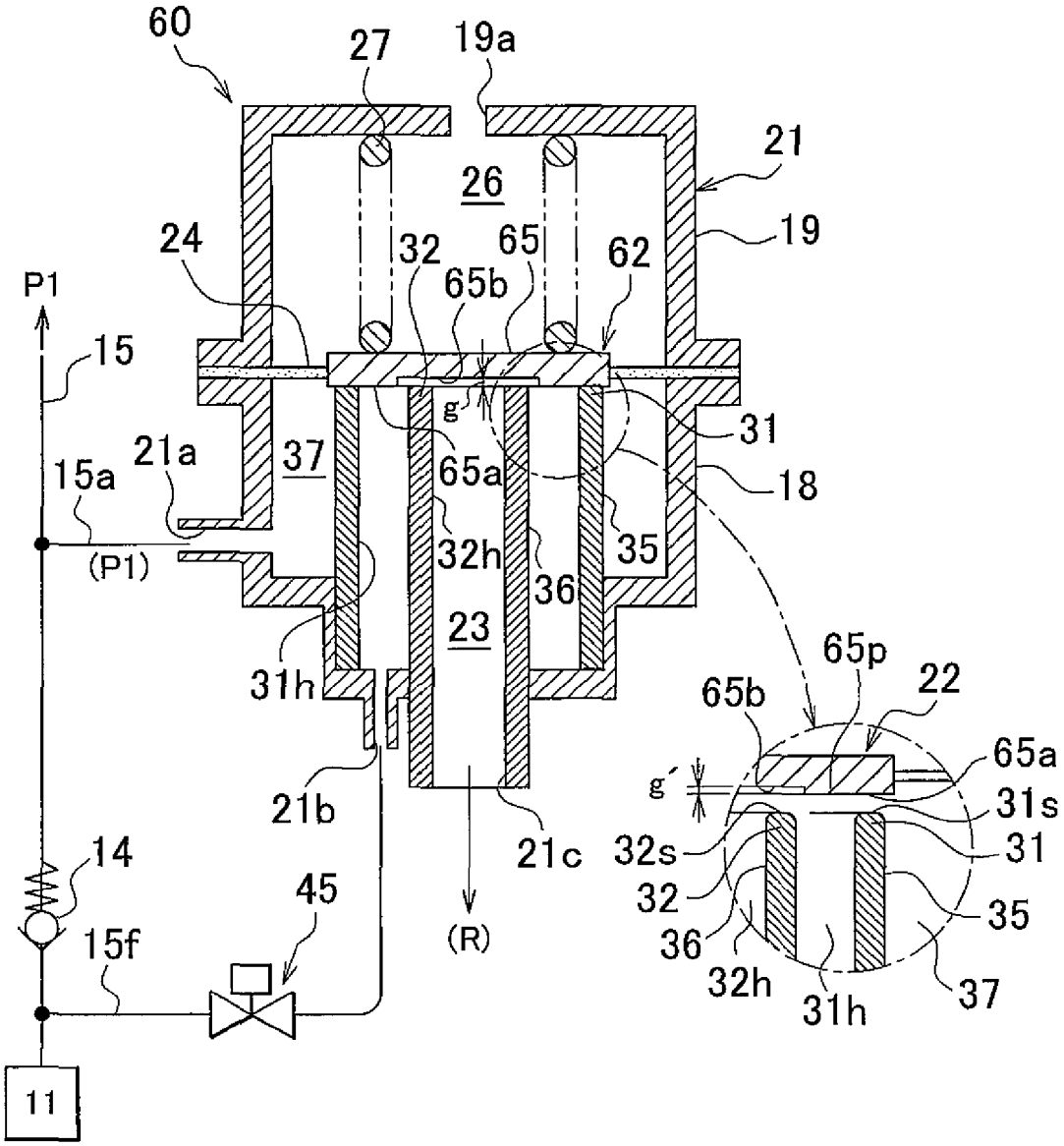
FIG. 7 is a block diagram schematically showing a fluid pressure regulating device according to a third example embodiment of the invention.

FIGS. 7 and 8 are views of a fluid pressure regulating device and a fuel supply system using this device, according to a third example embodiment of the invention.

As shown in FIG. 7, the fuel supply system of this third example embodiment is provided with a pressure regulator 60. This pressure regulator 60 includes a housing 21 that has an outside communication hole 21*a* into which pressurized fuel from a fuel pump 11 is constantly introduced when the fuel pump 11 is operating, an inside communication hole 21*c* to which fuel that has been introduced into a pressure regulating chamber 23 is discharged, and a middle communication hole 21*b* into which pressurized fuel from the fuel pump 11 is selectively introduced as pilot pressure via an electromagnetic valve 45. A pressure regulating chamber 23 is formed by this housing 21 and a partition-shaped pressure regulating member 62, just as in the first example embodiment.

Also, the pressure regulating member 62 is formed by a flexible annular membrane member 24 and a plate-shaped member 65 that is generally disc-shaped (i.e., a plate-shaped movable valve body portion) and that is positioned on the inner peripheral side of the annular membrane member 24, integrally assembled together. The annular membrane member 24 constantly receives the pressure of the fuel introduced into an outer fuel passage 37 from the outside communication hole 21*a* on one side of the annular membrane member 24.

Here, the plate-shaped member 65 has an annular step g on a valve surface portion 65*a* (one side portion) that faces an outer annular valve seat portion 31 and an inner annular valve seat portion 32. The plate-shaped member 65 also has an annular convex portion 65*p* that abuts against the outer annular valve seat portion 31 that is one valve seat portion from among the outer annular valve seat portion 31 and the inner annular valve seat portion 32, and a circular concave portion 65*b* that is generally disc shaped and is formed by the annular step g.

Figure 8A:
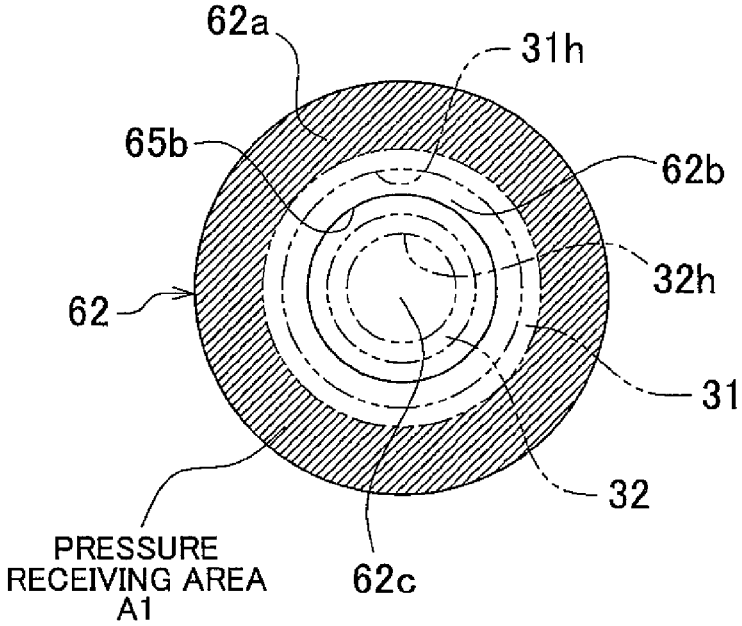
FIG. 8A is a view of the arrangement of a pressure receiving region, when a set pressure is on a high pressure side, of a pressure regulating member of the fluid pressure regulating device according to the third example embodiment of the invention.
Figure 8B:
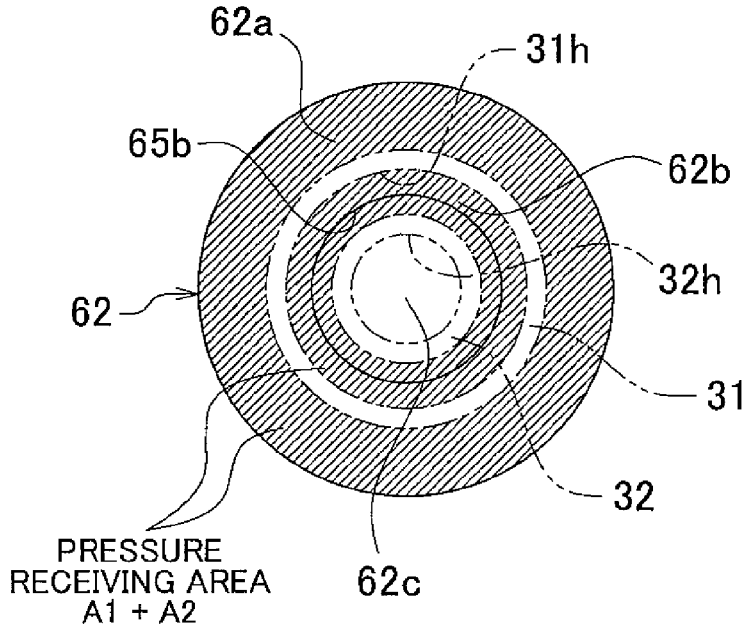
FIG. 8B is a view of an arrangement of pressure receiving regions, when a set pressure is on a low pressure side, of the pressure regulating member of the fluid pressure regulating device.

Also, the pressure regulating member 62 has an outer annular surface portion 62*a* that receives fluid pressure introduced into the outer fuel passage 37, a middle annular surface portion 62*b* that receives the pressure of pilot pressure fuel selectively introduced to the middle fuel passage 31*h*, and a circular center surface portion 62*c* that faces the inner end portion of the inner fuel passage 32*h*, as shown in FIGS. 8A and 8B.

Meanwhile, the large diameter outer annular valve seat portion 31 and the small diameter inner annular valve seat portion 32 that face one side of the plate-shaped member 65 of the pressure regulating member 62 are arranged substantially concentric inside the pressure regulating chamber 23. The outer annular valve seat portion 31 and the inner annular valve seat portion 32 and the pressure regulating member 62 form a pressure regulating valve mechanism that opens and closes by relative displacement.

The plate-shaped member 65 (a movable valve body portion) closes off communication between the outer fuel passage 37, and the middle fuel passage 31*h* and the inner fuel passage 32*h*, when a valve surface portion 65*a* (one side portion) is seated on the outer annular valve seat portion 31. Also, when the pressure of the pressurized fuel from the fuel pump 11 is applied to at least the outer annular surface portion 62*a*, from among the outer annular surface portion 62*a* and the middle annular surface portion 62*b* of the pressure regulating member 62, the pressure regulator 60 is able to regulate the pressure of the fuel on the supply side that is introduced into the outer fuel passage 37 to a set pressure by the pressure regulating member 62 opening and closing communication between the outer fuel passage 37, and the middle fuel passage 31*h* and the inner fuel passage 32*h*.

In this way, in this example embodiment, the outer fuel passage 37, the middle fuel passage 31*h*, and the inner fuel passage 32*h* are each arranged on one side of the pressure regulating member 62. The pressure regulating member 62 opens and closes communication between the outer fuel passage 37, and the middle fuel passage 31*h* and the inner fuel passage 32*h*, according to i) the urging force in the valve opening direction (i.e., the direction that communicates the outer fuel passage 37 with the middle fuel passage 31*h* and the inner fuel passage 32*h*) based on the pressure of the fuel introduced into the outer fuel passage 37 inside the housing 21, as well as based on the pilot pressure selectively introduced into the middle fuel passage 31*h*, and ii)the urging force in the valve closing direction (i.e., the direction that closes off communication between the outer fuel passage 37, and the middle fuel passage 31*h* and the inner fuel passage 32*h*) from the compression coil spring 27.

Meanwhile, the outer annular valve seat portion 31 and the inner annular valve seat portion 32 are such that a clearance between the pressure regulating member 62 and the outer annular valve seat portion 31 is set different from a clearance between the pressure regulating member 62 and the inner annular valve seat portion 32, such that when the outer annular valve seat portion 31 that is one of the valve seat portions abuts against the valve surface portion 65*a* of the plate-shaped member 65 of the pressure regulating member 62 (i.e., when the pressure regulating member 62 is seated on the outer annular valve seat portion 31), there is a small annular gap g between the inner annular valve seat portion 32 that is the other valve seat portion, and the plate-shaped member 65 of the pressure regulating member 62.

In other words, in this example embodiment, by forming the annular convex portion 65*p* that abuts against the outer annular valve seat portion 31, and the circular concave portion 65*b* that is recessed with respect to the annular convex portion 65*p*, on one side of the plate-shaped member 65, the valve surface portion 65*a* that abuts against the valve seat surface 31*s* of the outer annular valve seat portion 31, and the inside bottom surface, of the circular convex portion 65*b* that faces the valve seat surface 32*s* of the inner annular valve seat portion 32 form a step g' that corresponds to the small gap g in the axial direction of an outer cylindrical member 35 and an inner cylindrical member 36, that is the displacement direction of the plate-shaped member 65 of the pressure regulating member 62.

In the fuel supply system of the example embodiment structured as described above, when the electromagnetic valve 45 is on (i.e., in the valve closed state), fuel is supplied from the fuel pump 11 to only the outer fuel passage 37, of the outer fuel passage 37 and the middle fuel passage 31*h*, so the pressure receiving region of the pressure regulating member 62 that receives the pressure of the pressurized fuel is only the outer annular surface portion 62*a* of the pressure receiving area A1, as shown in FIG. 8A. Therefore, if the high set pressure is H [kPa], the pressure regulating member 62 receives the urging force H×A1 in the valve closing direction from the compression coil spring 27, while receiving the urging force P1×A1 in the valve opening direction at the outer annular surface portion 62*a* to which the fuel pressure P1 inside the outer fuel passage 37 is applied, so the pressure is regulated such that the urging force H×A1 in the valve closing direction from the compression coil spring 27 and the urging force P1×A1 in the valve opening direction that is based on the fuel pressure inside the pressure regulating chamber 23 balance out. As a result, the fuel pressure P1 at this time becomes the high set pressure H.

On the other hand, when the electromagnetic valve 45 is off (i.e., in the valve open state), fuel is supplied from the fuel pump 11 to both the outer fuel passage 37 and the middle fuel passage 31*h*, so the pressure receiving region of the pressure regulating member 62 that receives the pressure of the pressurized fuel is both the outer annular surface portion 62*a* of the pressure receiving area A1 and the middle annular surface portion 62*b* of the pressure receiving area A2, as shown in FIG. 8B. Therefore, when the high set pressure is H [kPa], the pressure regulating member 62 receives the urging force H×A1 in the valve closing direction from the compression coil spring 27, while receiving both the urging force P1×A1 in the valve opening direction at the outer annular surface portion 62*a* to which the fuel pressure P1 inside the outer fuel passage 37 is applied, and the urging force P1×A2 in the valve opening direction at the middle annular surface portion 62*b* to which the fuel pressure P2(=P1) inside the middle fuel passage 31*h* is applied, so the pressure is regulated such that the urging force H×A3 in the valve closing direction from the compression coil spring 27 and the urging force P1 (A1+A2) in the valve opening direction that is based on the fuel pressure inside the pressure regulating chamber 23 balance out. Accordingly, the fuel pressure P1 at this time is equal to H×A1/(A1+A2), which is the low set pressure L (i.e., P1=H×A1/(A1+A2)=low set pressure L).

In the fuel supply system of the example embodiment structured as described above, the pressure regulating member 62 that constantly receives urging force in the valve closing direction from the compression coil spring 27 changes the communication state between the outer fuel passage 37 on the fluid introduction side and the inner fuel passage 32*h* on the fluid discharge side according to the fluid pressure applied in the valve opening direction inside the pressure regulating chamber 23. As a result, the pressure of the fuel introduced into the inner fuel passage 32*h* on the fluid introduction side is regulated to a preset set pressure. Further, the middle fuel passage 31*h* can be used for the introduction of pilot pressure fuel, so the set pressure of the pressure regulator 60 can be changed between the high pressure side and the low pressure side by changing the pressure receiving area of the pressure regulating member 62, which is accomplished by introducing fuel pressure as the pilot pressure into the middle fuel passage 31*h* in conjunction with the outer fuel passage 37.

Also, sealability is not required at the inner annular valve seat portion 32. Therefore, the housing 21 having the outer annular valve seat portion 31 and the inner annular valve seat portion 32 can be more easily manufactured compared with when the outer annular valve seat portion 31 and the inner annular valve seat portion 32 are both made to abut against the valve surface portion 65*a* of the plate-shaped member 65.

Furthermore, in this example embodiment, the set pressure is switched between a plurality of set pressures, i.e., a high set pressure and a low set pressure, by controlling the inflow and outflow of fuel with only one side of the pressure regulating member 62, which is accomplished by regulating the pressure of the fuel supplied from the fuel pump 11 to the injectors 3 of the engine 1 using the pressure regulator 60 described above. As a result, there is no longer a need for a fluid passage to the back pressure chamber 26 side, nor is it necessary to use a plurality of pressure regulators. Thus, a low cost fuel supply system that is suitable for switching the set pressure, and that is compact due to having a simple passage configuration, can be provided. Moreover, the outer annular valve seat portion 31 and the inner annular valve seat portion 32 are able to be easily produced, while the required seal performance at the outer annular valve seat portion 31 that separates the outer fuel passage 37 on the fuel introduction side from the inner fuel passage 32*h* on the fuel discharge side is stably ensured. Thus, a fuel supply system capable of stably regulating fluid pressure and maintaining that pressure regulating value is able to be provided. Accordingly, this example embodiment is able to yield the same effects as the first example embodiment described above.

(Fourth Example Embodiment)

Figure 9:
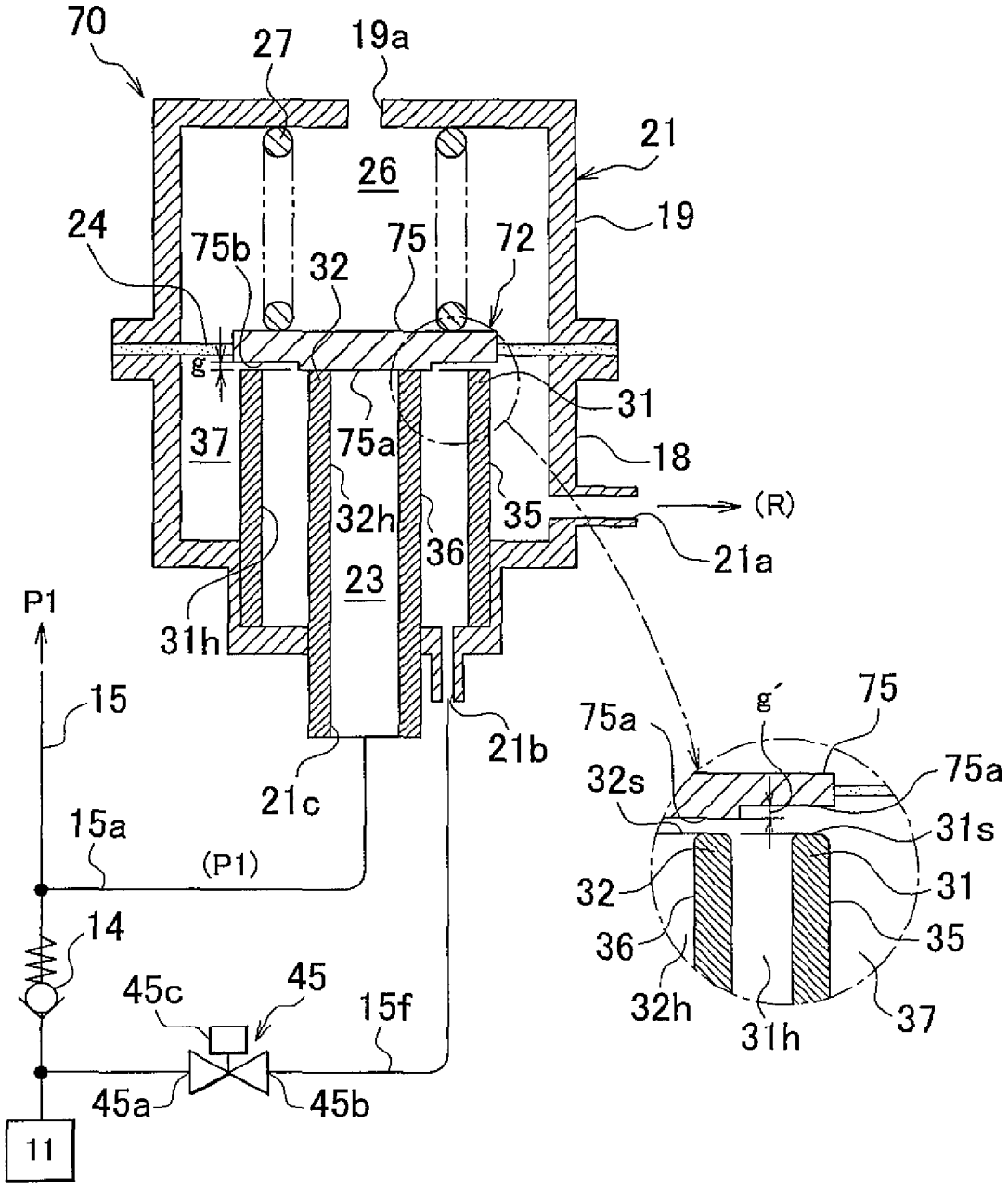
FIG. 9 is a block diagram schematically showing a fluid pressure regulating device according to a fourth example embodiment of the invention.

FIGS. 9 and 10 are views of a fluid pressure regulating device and a fuel supply system using this device, according to a fourth example embodiment of the invention.

As shown in FIG. 9, the fuel supply system of this fourth example embodiment is provided with a pressure regulator 70. This pressure regulator 70 includes a housing 21 that has an inside communication hole 21*c* into which pressurized fuel from a fuel pump 11 is constantly introduced when the fuel pump 11 is operating, an outside communication hole 21*a* to which fuel that has been introduced into a pressure regulating chamber 23 is discharged, and a middle communication hole 21 b to which pressurized fuel from the fuel pump 11 is selectively introduced as pilot pressure via an electromagnetic valve 45. The pressure regulating chamber 23 is formed by this housing 21 and a partition-shaped pressure regulating member 72, just as in the first example embodiment described above.

Also, a large diameter outer annular valve seat portion 31 and a small diameter inner annular valve seat portion 32 that face a valve surface portion 75*a* of a plate-shaped member 75 of the pressure regulating member 72 are arranged substantially concentric inside the pressure regulating chamber 23. The outer annular valve seat portion 31 and the inner annular valve seat portion 32 and the pressure regulating member 72 form a pressure regulating valve mechanism that opens and closes by relative displacement.

The outer annular valve seat portion 31 and the inner annular valve seat portion 32 separate an inner fuel passage 32*h* that is a fluid introduction side fluid passage from an outer fuel passage 37 that is a fluid discharge side fluid passage inside the pressure regulating chamber 23, as well as form a middle fuel passage 31*h* (i.e., another fluid passage) in the pressure regulating chamber 23. This middle fuel passage 31*h* is switched between being communicated with the inner fuel passage 32*h* and being communicated with the outer fuel passage 37, by the pressure regulating member 72, for example. That is, the outer annular valve seat portion 31 (i.e., a second valve seat portion) forms the outer fuel passage 37, that is the fluid discharge side fluid passage, between it (i.e., the outer annular valve seat portion 31) and the housing 21, and forms the middle fuel passage 31*h* between it (i.e., the outer annular valve seat portion 31) and the inner annular valve seat portion 32 (i.e., a first valve seat portion). The inner annular valve seat portion 32 (i.e., the first valve seat portion) forms the inner fuel passage 32*h* that is the fluid introduction side fluid passage, and separates the inner fuel passage 32*h* from the outer annular valve seat portion 31 and the middle fuel passage 31*h*.

Also, the inner fuel passage 32*h* is connected to a branch passage 15*a* (i.e., a supply side branch passage) of a fuel passage 15 that is a circuit portion downstream of a check valve 14 of a fuel delivery circuit 10, and the outer fuel passage 37 opens into a fuel tank 2 through the middle communication hole 21*b*. The middle fuel passage 31*h* is connected to a second port 45*b* of the electromagnetic valve 45 through the middle communication hole 21*b*.

Figure 10A:
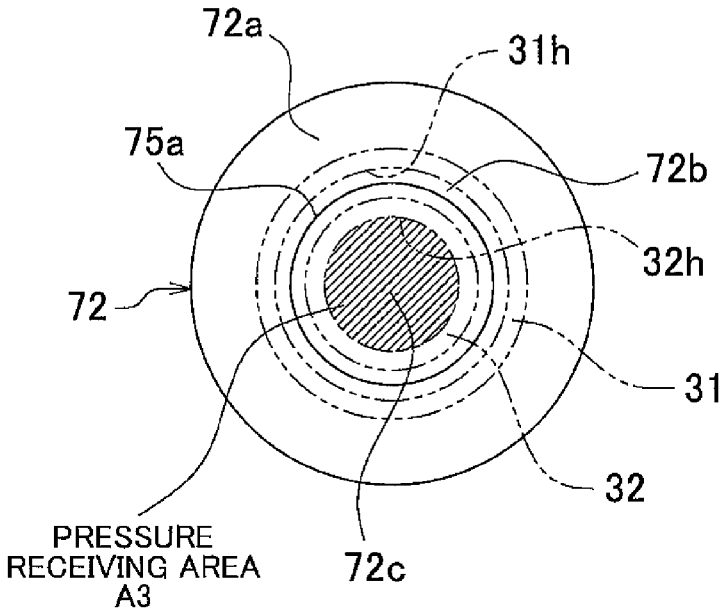
FIG. 10A is a view of the arrangement of a pressure receiving region, when a set pressure is on a high pressure side, of a pressure regulating member of the fluid pressure regulating device according to the fourth example embodiment of the invention.
Figure 10B:
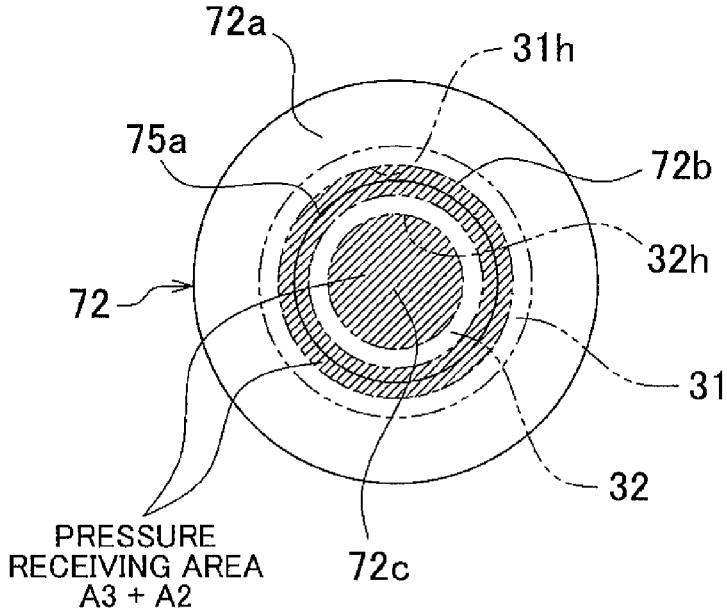
FIG. 10B is a view of an arrangement of pressure receiving regions, when a set pressure is on a low pressure side, of the pressure regulating member of the fluid pressure regulating device.

As shown in FIGS. 10A and 10B, an outer annular surface portion 72*a* of the pressure regulating member 72 receives the internal pressure (atmospheric pressure) of the fuel tank 2 that is introduced into the outer fuel passage 37, so this outer annular surface portion 72*a* is essentially not pressurized. Also, a middle annular surface portion 72*b* of the pressure regulating member 72 receives the pressure of the fuel inside the middle fuel passage 31*h*, and a circular center surface portion 72*c* of the pressure regulating member 72 constantly receives the fuel pressure inside the inner fuel passage 32*h* into which pressurized fuel is introduced while the fuel pump 11 is operating. Also, the fuel pressure inside the middle fuel passage 31*h* changes depending on whether the electromagnetic valve 45 is on or off, i.e., depending on whether the pressure of the pressurized fuel from the fuel pump 11 is introduced as pilot pressure.

The electromagnetic valve 45 switches the region where the pressure of the pressurized fuel is applied to the pressure regulating member 72 to only the circular center surface portion 72*c* of a pressure receiving area A3 or to both the circular center surface portion 72*c* of the pressure receiving area A3 and the middle annular surface portion 72*b* of the pressure receiving area A2, by changing the fuel pressure inside the middle fuel passage 31*h* that is applied to the middle annular surface portion 72*b* of the pressure regulating member 72, which is accomplished by selectively restricting the inflow of pilot pressure fuel into the middle fuel passage 31*h*. Then the pressure regulating member 72 is able to switch the set pressure of the pressure regulator 70 by changing the substantive pressure receiving area of the pressure regulating member 72 according to the pressure of the fuel inside the middle fuel passage 31*h* that is applied to the middle annular surface portion 72*b* (i.e., according to the pilot pressure). Here, the pressure receiving area A3 of the inner fuel passage 32*h* and the pressure receiving area A2 of the middle annular surface portion 72*b* on the inside are set such that the area ratio A3/A2 becomes a preset area ratio.

The plate-shaped member 75 (a movable valve body portion) closes off communication between the inner fuel passage 32*h*, and the middle fuel passage 31*h* and the outer fuel passage 37, when a valve surface portion 75*a* (one side portion) is seated on the inner annular valve seat portion 32. The outer annular valve seat portion 31 and the inner annular valve seat portion 32 have valve seat surfaces 31*s* and 32*s*, respectively, that are both parallel to the valve surface portion 75*a* of the plate-shaped member 75. Also, when the pressure of the pressurized fuel from the fuel pump 11 is applied to at least the circular center surface portion 72*c*, from among the circular center surface portion 72*c* and the middle annular surface portion 72*b* of the pressure regulating member 72, the pressure regulator 70 is able to regulate the pressure of the fuel on the supply side that is introduced into the inner fuel passage 72*h* to a set pressure by the pressure regulating member 72 opening and closing communication between the inner fuel passage 32*h*, and the middle fuel passage 31*h* and the outer fuel passage 37.

In this way, in this example embodiment, the outer fuel passage 37, the middle fuel passage 31*h*, and the inner fuel passage 32*h* are each arranged on one side of the pressure regulating member 72. The pressure regulating member 72 opens and closes communication between the inner fuel passage 32*h*, and the middle fuel passage 31*h* and the outer fuel passage 37, according to i) the urging force in the valve opening direction (i.e., the direction that communicates the inner fuel passage 32*h* with the middle fuel passage 31*h* and the outer fuel passage 37) based on the pressure of the fuel introduced into the inner fuel passage 32*h* inside the housing 21, as well as based on the pilot pressure selectively introduced into the middle fuel passage 31*h*, and ii) the urging force in the valve closing direction (i.e., the direction that closes off communication between the inner fuel passage 32*h*, and the middle fuel passage 31*h* and the outer fuel passage 37) from the compression coil spring 27.

Meanwhile, the outer annular valve seat portion 31 and the inner annular valve seat portion 32 are such that a clearance between the pressure regulating member 72 and the outer annular valve seat portion 31 is set different from a clearance between the pressure regulating member 72 and the inner annular valve seat portion 32, such that when the inner annular valve seat portion 32 that is one of the valve seat portions abuts against the valve surface portion 75*a* of the plate-shaped member 75 of the pressure regulating member 72 (i.e., when the pressure regulating member 72 is seated on the inner annular valve seat portion 32), there is a small annular gap g between the outer annular valve seat portion 31 that is the other valve seat portion, and the plate-shaped member 75 of the pressure regulating member 72.

In other words, in this example embodiment, the plate-shaped member 75 is formed so as to create a circular convex shape on one side of the center portion. As a result, the plate-shaped member 75 has an outer annular valve surface portion 75*b* that faces the outer annular valve seat portion 31, and a center circular valve surface portion 75*a* (i.e., a circular convex portion) that faces the inner annular valve seat portion 32, such that an annular step g' is formed between the center circular valve surface portion 75*a* and the outer annular valve surface portion 75*b*. The plate-shaped member 75 forms a shape that abuts only against the inner annular valve seat portion 32 (i.e., one valve seat portion), so the valve seat surface 31*s* of the outer annular valve seat portion 31 forms a small gap g in the axial direction of the outer annular valve seat portion 31 and the inner annular valve seat portion 32, that is the displacement direction of the plate-shaped member 75 of the pressure regulating member 72, with respect to the outer annular valve surface portion 75*b* of the plate-shaped member 75 of the pressure regulating member 72.

In the fuel supply system of the example embodiment structured as described above, when the electromagnetic valve 45 is on (i.e., in the valve closed state), fuel is supplied from the fuel pump 11 to only the inner fuel passage 32*h*, of the inner fuel passage 32*h* and the middle fuel passage 31*h*, so the pressure receiving region of the pressure regulating member 72 that receives the pressure of the pressurized fuel is only the circular center surface portion 72*c* of the pressure receiving area A3, as shown in FIG. 10A. Therefore, if the high set pressure is H [kPa], the pressure regulating member 72 receives the urging force H×A3 in the valve closing direction from the compression coil spring 27, while receiving the urging force P1×A3 in the valve opening direction at the circular center surface portion 72*c* to which the fuel pressure P1 inside the inner fuel passage 32*h* is applied, so the pressure is regulated such that the urging force H×A3 in the valve closing direction from the compression coil spring 27 and the urging force P1×A3 in the valve opening direction that is based on the fuel pressure inside the pressure regulating chamber 23 balance out. As a result, the fuel pressure P1 at this time becomes the high set pressure H.

On the other hand, when the electromagnetic valve 45 is off (i.e., in the valve open state), fuel is supplied from the fuel pump 11 to both the inner fuel passage 32*h* and the middle fuel passage 31*h*, so the pressure receiving region of the pressure regulating member 72 that receives the pressure of the pressurized fuel is both the circular center surface portion 72*c* of the pressure receiving area A3 and the middle annular surface portion 72*b* of the pressure receiving area A2, as shown in FIG. 10B. Therefore, when the high set pressure is H [kPa], the pressure regulating member 72 receives the urging force H×A3 in the valve closing direction from the compression coil spring 27, while receiving both the urging force P1×A3 in the valve opening direction at the circular center surface portion 72*c* to which the fuel pressure P1 inside the inner fuel passage 32*h* is applied, and the urging force P1×A2 in the valve opening direction at the middle annular surface portion 72*b* to which the fuel pressure P2(=P1) inside the middle fuel passage 31*h* is applied, so the pressure is regulated such that the urging force H×A3 in the valve closing direction from the compression coil spring 27 and the urging force P1 (A3+A2) in the valve opening direction that is based on the fuel pressure inside the pressure regulating chamber 23 balance out. Accordingly, the fuel pressure P1 at this time is equal to H×A3/(A3+A2), which is the low set pressure L (i.e., P1=H×A3/(A3+A2)=low set pressure L).

In the fuel supply system of the example embodiment structured as described above, the pressure regulating member 72 that constantly receives urging force in the valve closing direction from the compression coil spring 27 changes the communication state between the inner fuel passage 32*h* on the fluid introduction side and the outer fuel passage 37 on the fluid discharge side according to the fluid pressure applied in the valve opening direction inside the pressure regulating chamber 23. As a result, the pressure of the fuel introduced into the inner fuel passage 32*h* on the fluid introduction side is regulated to a preset set pressure. Further, the middle fuel passage 31*h* can be used for the introduction of pilot pressure fuel or the discharge of fuel, so the set pressure of the pressure regulator 70 can be changed between the high pressure side and the low pressure side by changing the pressure receiving area of the pressure regulating member 72, which is accomplished by introducing fuel pressure as the pilot pressure into the middle fuel passage 31*h* in conjunction with the inner fuel passage 32*h*.

Also, sealability is not required at the outer annular valve seat portion 31. Therefore, the housing 21 having the outer annular valve seat portion 31 and the inner annular valve seat portion 32 can be more easily manufactured compared with when the outer annular valve seat portion 31 and the inner annular valve seat portion 32 are both made to abut against the valve surface portion 75*a* of the plate-shaped member 75.

Furthermore, in this example embodiment, the set pressure is switched between a plurality of set pressures, i.e., a high set pressure and a low set pressure, by controlling the inflow and outflow of fuel with only one side of the pressure regulating member 72, which is accomplished by regulating the pressure of the fuel supplied from the fuel pump 11 to the injectors 3 of the engine 1 using the pressure regulator 70 described above. As a result, there is no longer a need for a fluid passage to the back pressure chamber 26 side, nor is it necessary to use a plurality of pressure regulators. Thus, a low cost fuel supply system that is suitable for switching the set pressure, and that is compact due to having a simple passage configuration, can be provided. Moreover, the outer annular valve seat portion 31 and the inner annular valve seat portion 32 are able to be easily produced, while the required seal performance at the inner annular valve seat portion 32 that separates the inner fuel passage 32*h* on the fuel introduction side from the outer fuel passage 37 on the fuel discharge side is stably ensured. Thus, a fuel supply system capable of stably regulating fluid pressure and maintaining that pressure regulating value is able to be provided.

In addition, in this example embodiment, the plate-shaped member 75 has the annular step g' between the outer annular valve surface portion 75*b* that faces the outer annular valve seat portion 31 and the center circular valve surface portion 75*a* (i.e., the circular convex portion) that faces the inner annular valve seat portion 32, and also forms a shape that abuts against only the inner annular valve seat portion 32 (one of the valve seat portions). Therefore, sealability between the plate-shaped member 75 and the inner annular valve seat portion 32 when the valve is closed is improved. Also, an appropriate constriction can be formed at the inner edge portion of the middle fuel passage 31*h* by appropriately setting the small gap g (i.e., clearance) between the plate-shaped member 75 and the inner annular valve seat portion 32, and the rate (i.e., speed) at which the set pressure is switched can be adjusted according to this constriction.

Similar effects as those obtained with the first example embodiment described above can also be obtained with this example embodiment.

Incidentally, in the example embodiments described above, the electromagnetic valve 45 forms a set pressure switching valve that changes the fluid pressure inside a fluid passage such as the middle fuel passage 31*h* and 51*h* between the outer annular valve seat portion 31 and the inner annular valve seat portion 32 by selectively restricting the introduction of pilot pressure fuel into the pressure regulating chamber 23. However, in the invention, the set pressure switching valve may also be configured to selectively restrict the introduction of pilot pressure fuel into a given fuel passage (i.e., fluid passage) inside the pressure regulating chamber 23. Also, the set pressure switching valve may also be configured to selectively restrict the discharge of fuel (i.e., fluid) from a given fluid passage inside the pressure regulating chamber 23 into which pilot pressure fuel is introduced, instead of selectively restricting the introduction of pilot pressure fuel into a given fluid passage inside the pressure regulating chamber 23. Furthermore, an introduction switching valve that selectively restricts the introduction of pilot pressure fuel into a given fluid passage in the pressure regulating chamber 23 may be arranged together with a discharge switching valve that selectively restricts the discharge of fuel (i.e., fluid) from the given fluid passage, or a three-way valve that has the functions of both of these switching valves may be used.

More specifically, the structure may be such as any one of those in fifth to twelfth example embodiments shown in FIGS. 11 to 18, for example.

(Fifth to Eighth Example Embodiments)

Figure 11:
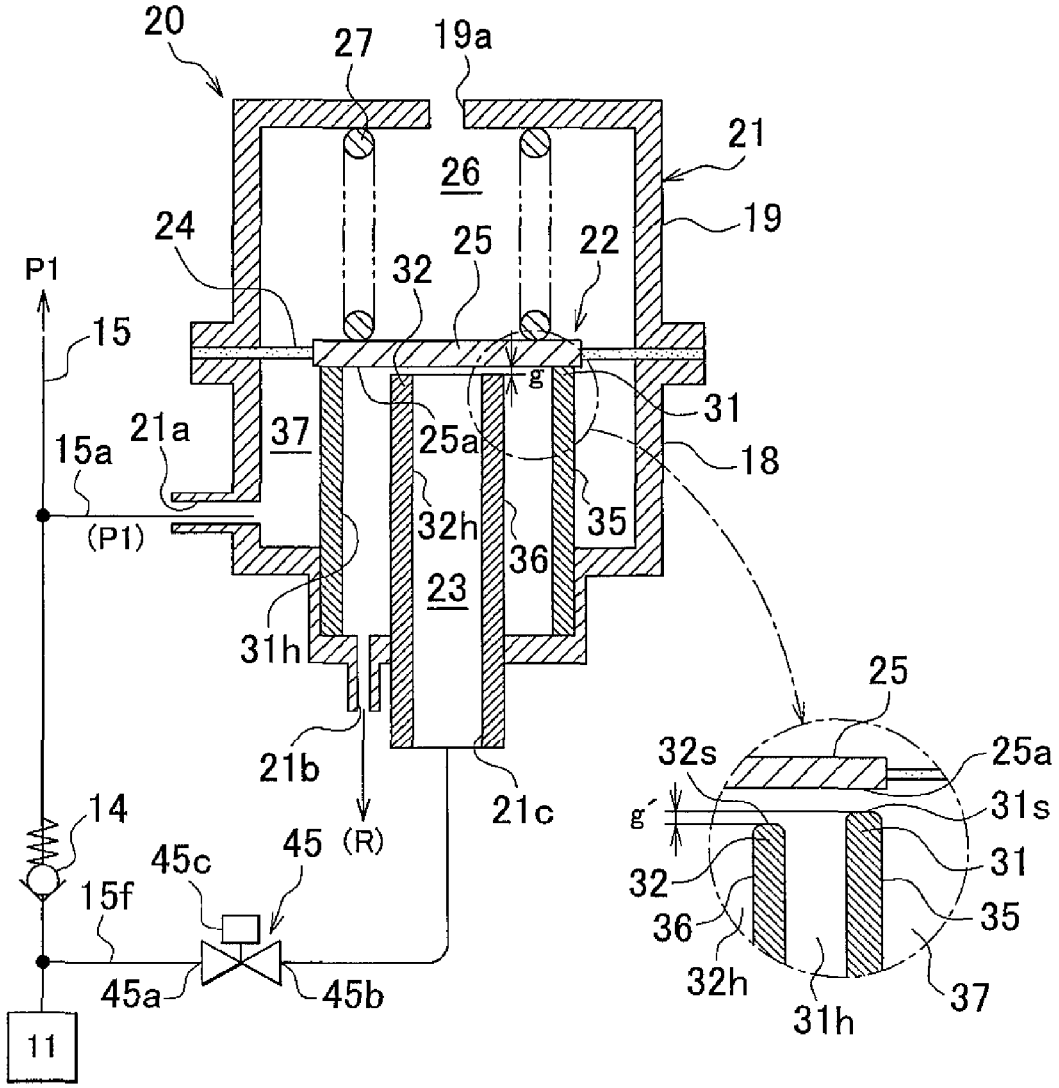
FIG. 11 is a block diagram schematically showing a fluid pressure regulating device according to a fifth example embodiment of the invention.

As shown in FIG. 11, in a fluid pressure regulating device and a fuel supply system using this fluid pressure regulating device according to a fifth example embodiment, the arrangement of the plurality of fluid passages in the pressure regulating chamber 23 is different than it is in the first example embodiment shown in FIGS. 1 to 4, and the middle fuel passage 31*h* between the outer annular valve seat portion 31 and the inner annular valve seat portion 32 is a return passage that discharges excess fuel. Also, the outer annular valve seat portion 31 and the inner annular valve seat portion 32 separate the outer fuel passage 37 that is a fluid introduction side fluid passage from the middle fuel passage 31*h* that is a fluid discharge side fluid passage inside the pressure regulating chamber 23, as well as form an inner fuel passage 32*h* (i.e., another fluid passage) to the inside of the inner annular valve seat portion 32 in the pressure regulating chamber 23. This inner fuel passage 32*h* is switched between being communicated with the outer fuel passage 37 and being communicated with the middle fuel passage 31*h*, by the pressure regulating member 22. Also, the electromagnetic valve 45 switches the region where the pressure of the pressurized fuel is applied to the pressure regulating member 22 to only the outer annular surface portion 22*a* of the pressure receiving area A1 or to both the outer annular surface portion 22*a* of the pressure receiving area A1 and the circular center surface portion 22*c* of the pressure receiving area A3, thereby changing the set pressure of the pressure regulator 20, by selectively restricting the introduction of pilot pressure fuel into the inner fuel passage 32*h* located to the inside of the inner annular valve seat portion 32.

Figure 12:
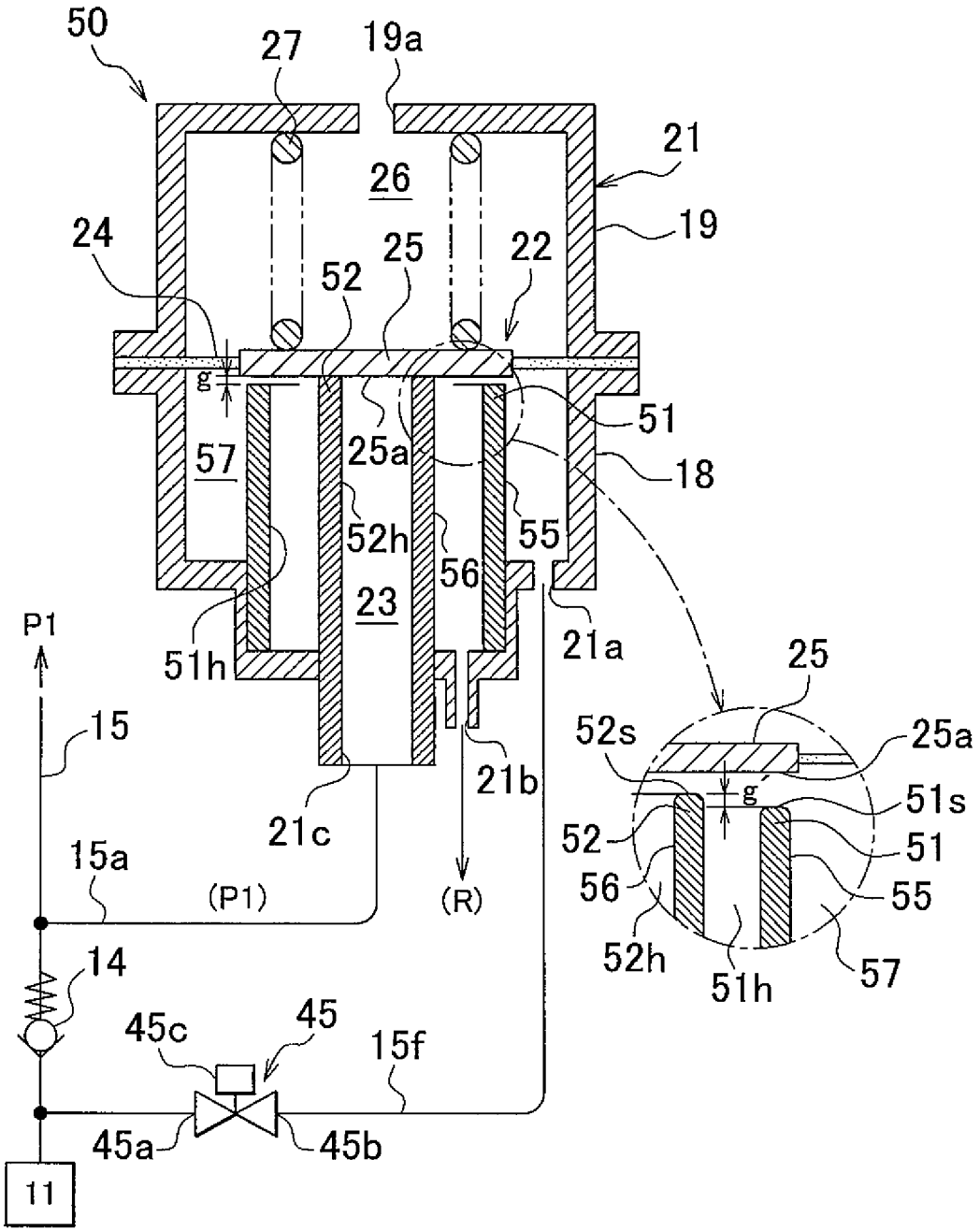
FIG. 12 is a block diagram schematically showing a fluid pressure regulating device according to a sixth example embodiment of the invention.

As shown in FIG. 12, in a fluid pressure regulating device and a fuel supply system using this fluid pressure regulating device according to a sixth example embodiment, the arrangement of the plurality of fluid passages in the pressure regulating chamber 23 is different than it is in the second example embodiment shown in FIGS. 5 and 6, and the middle fuel passage 51*h* between the outer annular valve seat portion 51 and the inner annular valve seat portion 52 is a return passage that discharges excess fuel. Also, the outer annular valve seat portion 51 and the inner annular valve seat portion 52 separate the inner fuel passage 52*h* that is a fluid introduction side fluid passage from the middle fuel passage 51*h* that is a fluid discharge side fluid passage inside the pressure regulating chamber 23, as well as form the annular outer fuel passage 57 (i.e., another fluid passage) to the inside of the outer annular valve seat portion 51 in the pressure regulating chamber 23. This annular outer fuel passage 57 is switched between being communicated with the inner fuel passage 52*h* and being communicated with the middle fuel passage 51*h*, by the pressure regulating member 22. Also, the electromagnetic valve 45 switches the region where the pressure of the pressurized fuel is applied to the pressure regulating member 22 to only the circular center surface portion 22*c* of the pressure receiving area A3 or to both the circular center surface portion 22*c* of the pressure receiving area A3 and the outer annular surface portion 22*a* of the pressure receiving area Al, thereby changing the set pressure of the pressure regulator 50, by selectively restricting the introduction of pilot pressure fuel into the annular outer fuel passage 57 located to the outside of the outer annular valve seat portion 51.

Figure 13:
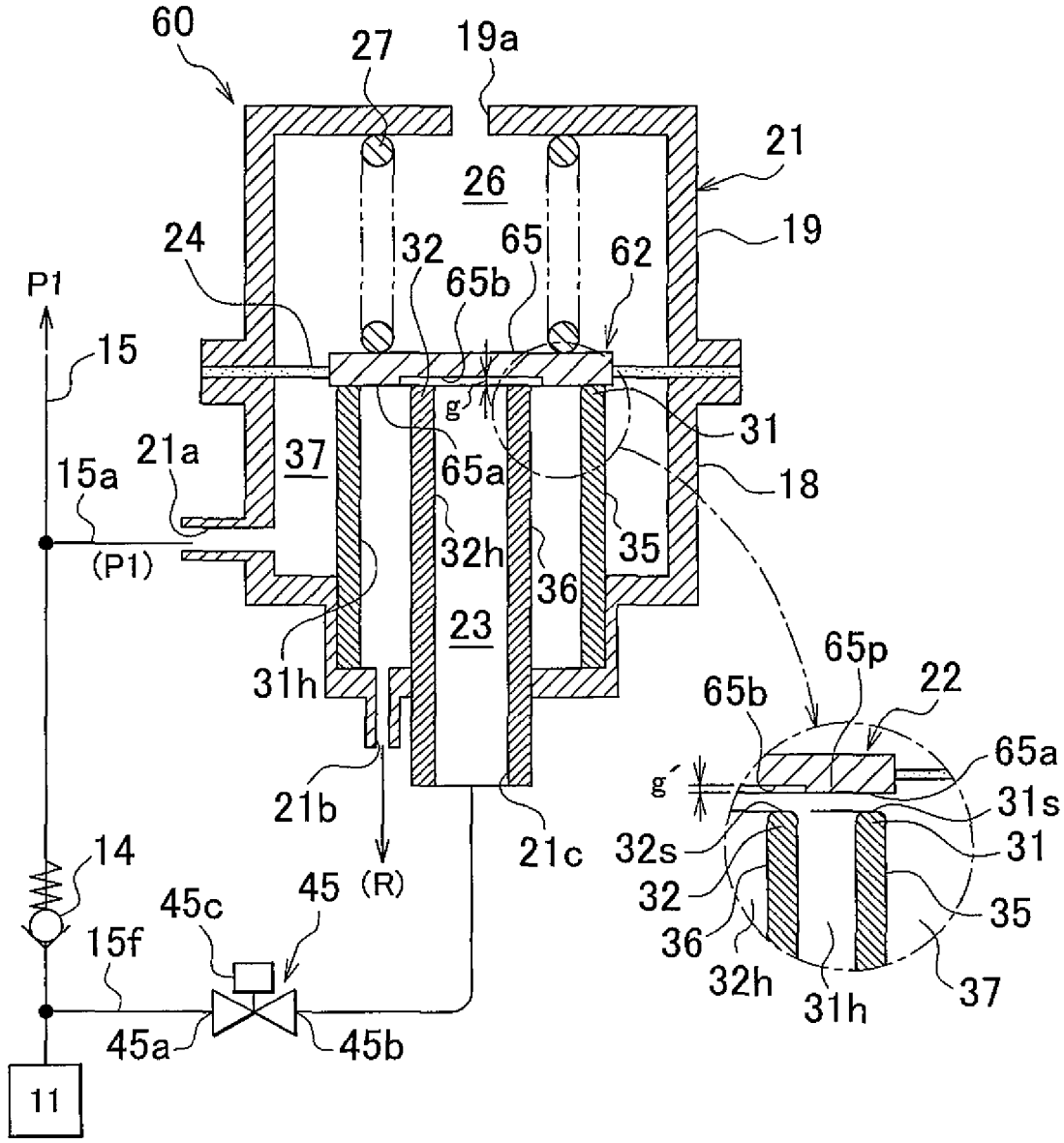
FIG. 13 is a block diagram schematically showing a fluid pressure regulating device according to a seventh example embodiment of the invention.

As shown in FIG. 13, in a fluid pressure regulating device and a fuel supply system using this fluid pressure regulating device according to a seventh example embodiment, the arrangement of the plurality of fluid passages in the pressure regulating chamber 23 is different than it is in the third example embodiment shown in FIGS. 7 and 8, and the middle fuel passage 31*h* between the outer annular valve seat portion 31 and the inner annular valve seat portion 32 is a return passage that discharges excess fuel. Also, the outer annular valve seat portion 31 and the inner annular valve seat portion 32 separate the outer fuel passage 37 that is a fluid introduction side fluid passage from the middle fuel passage 31*h* that is a fluid discharge side fluid passage inside the pressure regulating chamber 23, as well as form the inner fuel passage 32*h* (i.e., another fluid passage) to the inside of the inner annular valve seat portion 32 in the pressure regulating chamber 23. This inner fuel passage 32*h* is switched between being communicated with the outer fuel passage 37 and being communicated with the middle fuel passage 31*h*, by the pressure regulating member 62. Also, the electromagnetic valve 45 switches the region where the pressure of the pressurized fuel is applied to the pressure regulating member 62 to only the outer annular surface portion 62*a* of the pressure receiving area A1 (see FIG. 8) or to both the outer annular surface portion 62*a* of the pressure receiving area A1 and the circular center surface portion 62*c* of the pressure receiving area A3, thereby changing the set pressure of the pressure regulator 60, by selectively restricting the introduction of pilot pressure fuel into the inner fuel passage 32*h* located to the inside of the inner annular valve seat portion 32.

Figure 14:
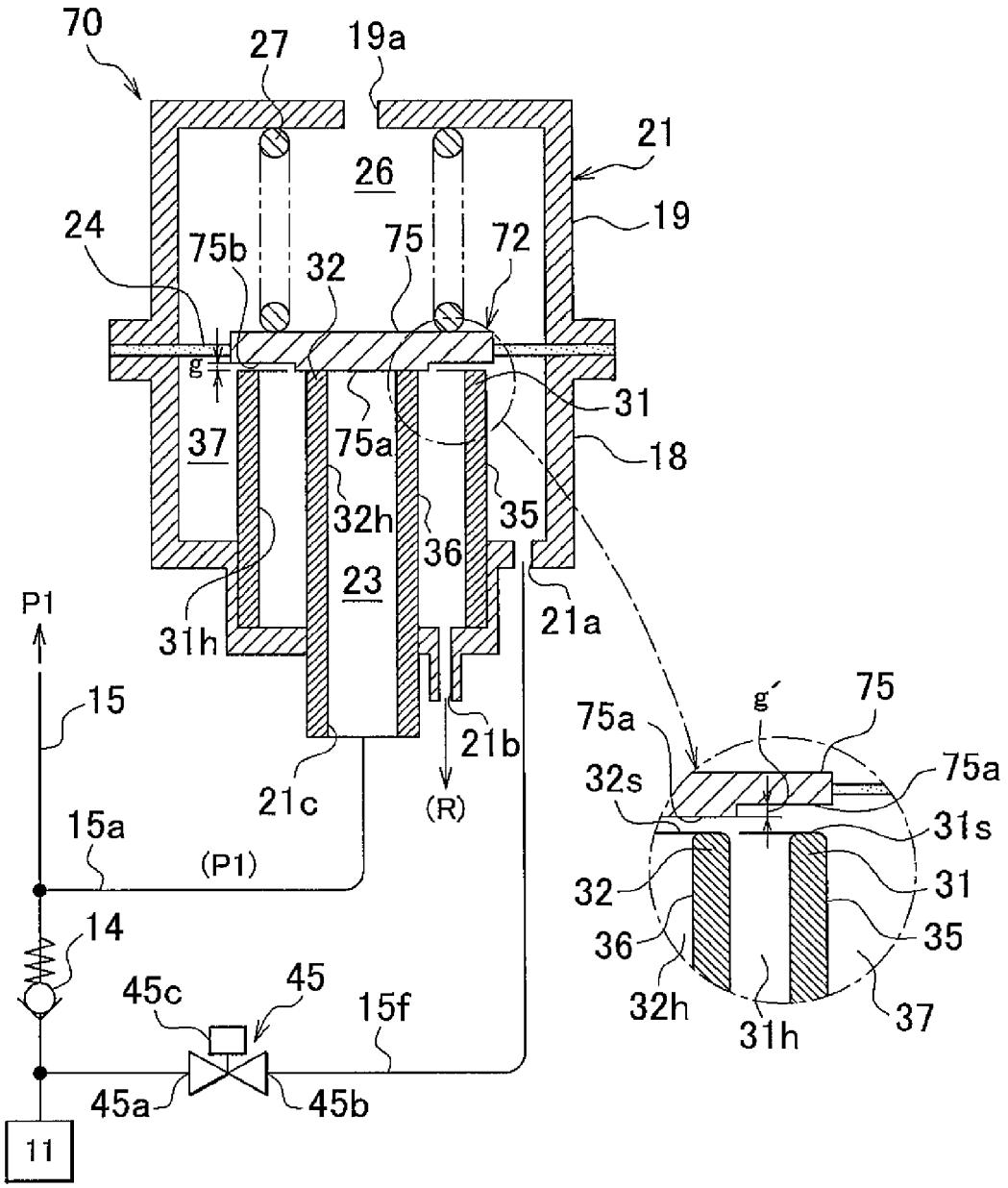
FIG. 14 is a block diagram schematically showing a fluid pressure regulating device according to an eighth example embodiment of the invention.

As shown in FIG. 14, in a fluid pressure regulating device and a fuel supply system using this fluid pressure regulating device according to an eighth example embodiment, the arrangement of the plurality of fluid passages in the pressure regulating chamber 23 is different than it is in the fourth example embodiment shown in FIGS. 9 and 10, and the middle fuel passage 31*h* between the outer annular valve seat portion 31 and the inner annular valve seat portion 32 is a return passage that discharges excess fuel. Also, the outer annular valve seat portion 31 and the inner annular valve seat portion 32 separate the inner fuel passage 32*h* that is a fluid introduction side fluid passage from the middle fuel passage 31*h* that is a fluid discharge side fluid passage inside the pressure regulating chamber 23, as well as form the outer fuel passage 37 (i.e., another fluid passage) to the outside of the outer annular valve seat portion 31 in the pressure regulating chamber 23. This outer fuel passage 37 is switched between being communicated with the inner fuel passage 32*h* and being communicated with the middle fuel passage 31*h*, by the pressure regulating member 72. Also, the electromagnetic valve 45 switches the region where the pressure of the pressurized fuel is applied to the pressure regulating member 72 to only the circular center surface portion 72*c* of the pressure receiving area A3 or to both the circular center surface portion 72*c* of the pressure receiving area A3 and the outer annular surface portion 72*a* of the pressure receiving area A1, thereby changing the set pressure of the pressure regulator 70, by selectively restricting the introduction of pilot pressure fuel into the outer fuel passage 37 located to the outside of the outer annular valve seat portion 31.

Figure 15:
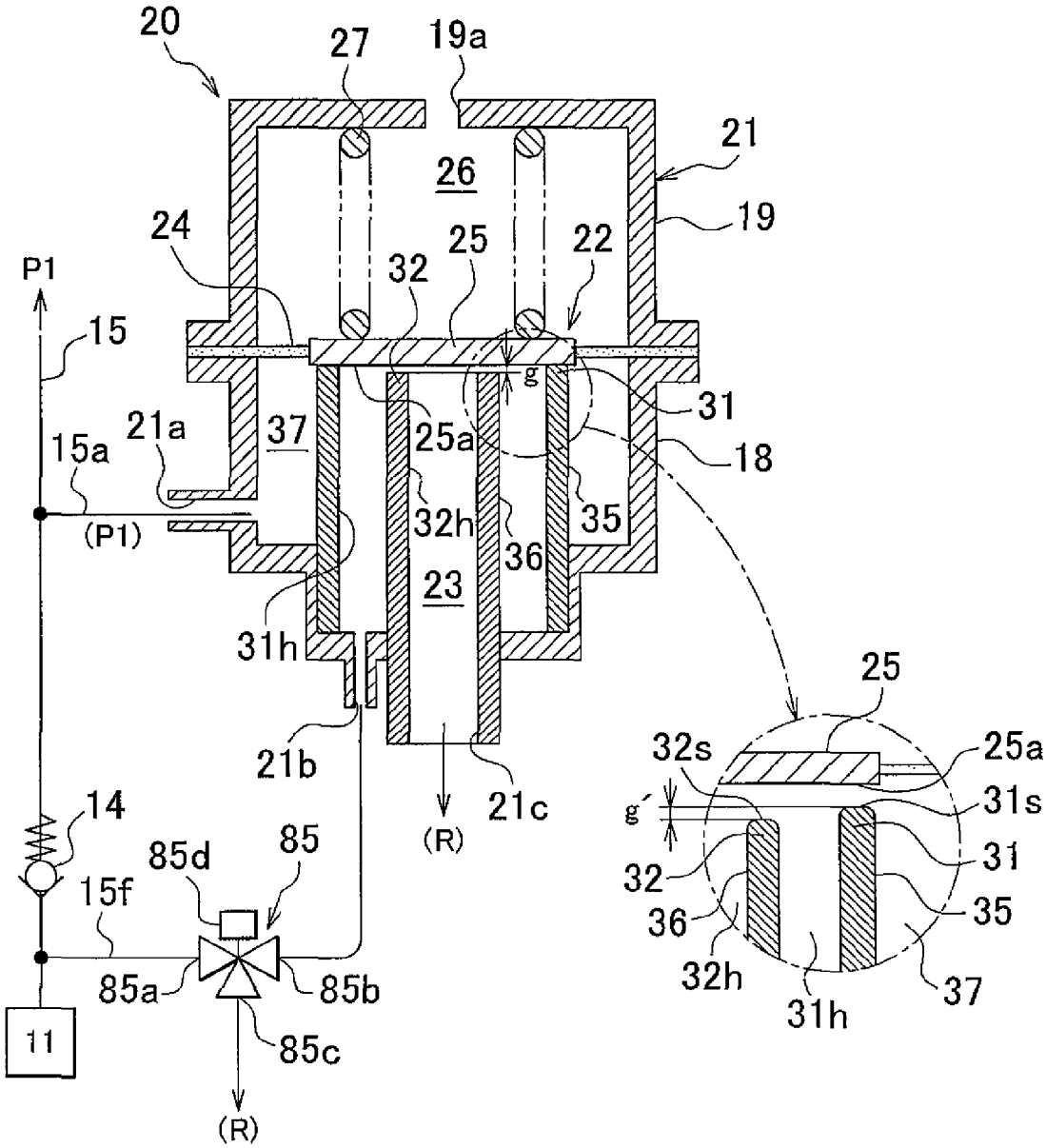
FIG. 15 is a block diagram schematically showing a fluid pressure regulating device according to a ninth example embodiment of the invention.

As shown in FIG. 15, a fluid pressure regulating device and a fuel supply system using this fluid pressure regulating device according to a ninth example embodiment use a three-way electromagnetic valve 85 instead of the electromagnetic valve 45 as in the first example embodiment shown in FIGS. 1 to 4. This three-way electromagnetic valve 85 functions both as i) an introduction switching valve that can selectively restrict the introduction of pressurized fuel (i.e., fuel that has been pressurized to the pilot pressure) into the middle fuel passage 31*h* on the upstream side of the middle fuel passage 31*h*, and ii) a discharge switching valve that selectively restricts the discharge the fuel on the middle fuel passage 31*h* side of the introduction switching valve, and thus the release of pressure inside the middle fuel passage 31*h* with that discharge of fuel, when the introduction switching valve closes to restrict the introduction of fuel into the middle fuel passage 31*h*. Also, the region where the pressure of the pressurized fuel is applied to the pressure regulating member 22 is switched to only the outer annular surface portion 22*a* of the pressure receiving area A1 or to both the outer annular surface portion 22*a* of the pressure receiving area A1 and the middle annular surface portion 22*b* of the pressure receiving area A2, by selectively restricting the introduction of pressurized fuel into the middle fuel passage 31*h* according to the open/closed state of the three-way electromagnetic valve 85.

Also, the three-way electromagnetic valve 85 has a first port 85*a* that is connected to an upstream portion of a second branch passage 15*f* of a fuel passage 15, a second port 85*b* that is connected to a downstream portion of the branch passage 15*f* of the fuel passage 15, a third port 85*c* that opens into an internal space of a fuel tank 2, and an electromagnetic operating portion 85*d* that switches the communication state between these three ports 85*a*, 85*b*, and 85*c*.

The electromagnetic operating portion 85*d* closes off the second port 85*b* from the first port 85*a* while opening the second port 85*b* to the third port 85*c* when turned on in response to receiving excitation driving current supplied from an ECU 41 side, and closes off the second port 85*b* from the third port 85*c* while opening the second port 85*b* to the first port 85*a* when turned off in response to receiving no excitation driving current from the ECU 41 side. Therefore, the first port 85*a* and the second port 85*b* of the three-way electromagnetic valve 85 correspond to the input port and the output port of the introduction switching valve described above, and the second port 85*b* of the three-way electromagnetic valve 85 corresponds to the input port and the output port of the discharge switching valve described above. Also, when the three-way electromagnetic valve 85 is on, it becomes closed as the introduction switching valve and open as the discharge switching valve. This three-way electromagnetic valve 85, together with the ECU 41, forms the set pressure switching mechanism 40 that executes set pressure switching control of the pressure regulator 20.

In this example embodiment, in addition to the effects of the first example embodiment, a simple set pressure switching mechanism that uses the three-way electromagnetic valve 85 is able to be realized by providing the three-way electromagnetic valve 85 (i.e., a set pressure switching valve; a three-way valve) that changes the fuel pressure in the middle fuel passage alb by selectively restricting both the introduction of pilot fuel pressure into the middle fuel passage 31*h* and the discharge of fuel from within the middle fuel passage 31*h*. Moreover, the clearances set between the pressure regulating member 22, and the outer annular valve seat portion 31 and the inner annular valve seat portion 32 can be reduced compared with when only restricting the introduction of pilot pressure. Also, when the pressure regulator 20 is set to the low pressure, the outflow amount of pilot pressure fuel from the middle fuel passage 31*h* is suppressed, thereby enabling the load on the fuel pump 11 to be reduced. Also, when the pressure regulator 20 is set to the high pressure, fuel within the middle fuel passage 31*h* can be quickly discharged, and thus the pressure can be quickly released, thus improving the responsiveness of a fuel pressure switch.

Figure 16:
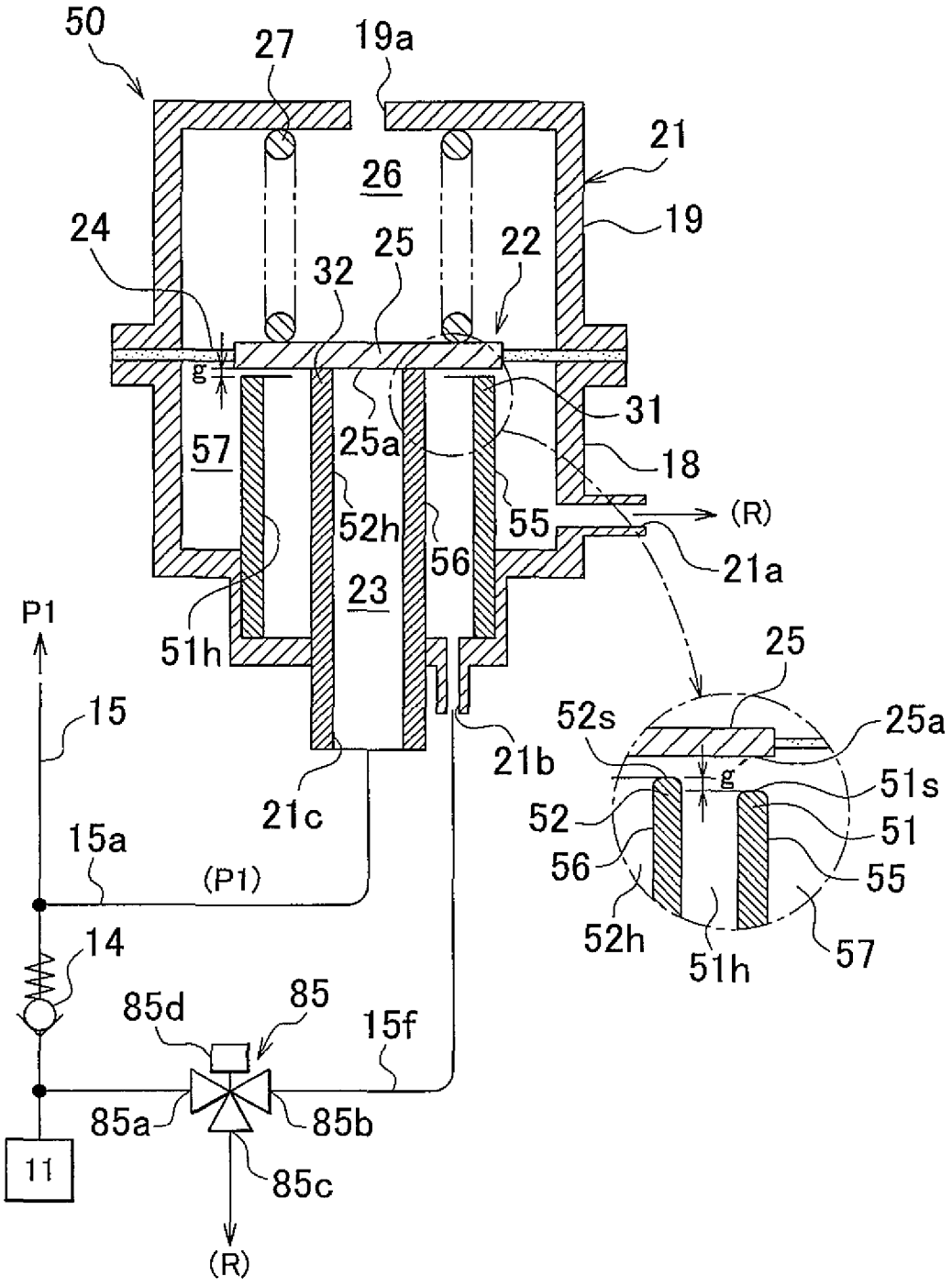
FIG. 16 is a block diagram schematically showing a fluid pressure regulating device according to a tenth example embodiment of the invention.

As shown in FIG. 16, a fluid pressure regulating device and a fuel supply system using this fluid pressure regulating device according to a tenth example embodiment use a three-way electromagnetic valve 85 instead of the electromagnetic valve 45 as in the second example embodiment shown in FIGS. 5 and 6. In addition to the effects of the second example embodiment, in this example embodiment, just as in the ninth example embodiment, when the pressure regulator 50 is set to a low pressure, the outflow amount of pilot pressure fuel is suppressed, thereby enabling the load on the fuel pump 11 to be reduced, and when the pressure regulator 50 is set to a high pressure, fuel within the middle fuel passage 31*h* can be quickly discharged, and thus the pilot pressure can be quickly released, thus improving the responsiveness of a fuel pressure switch.

Figure 17:
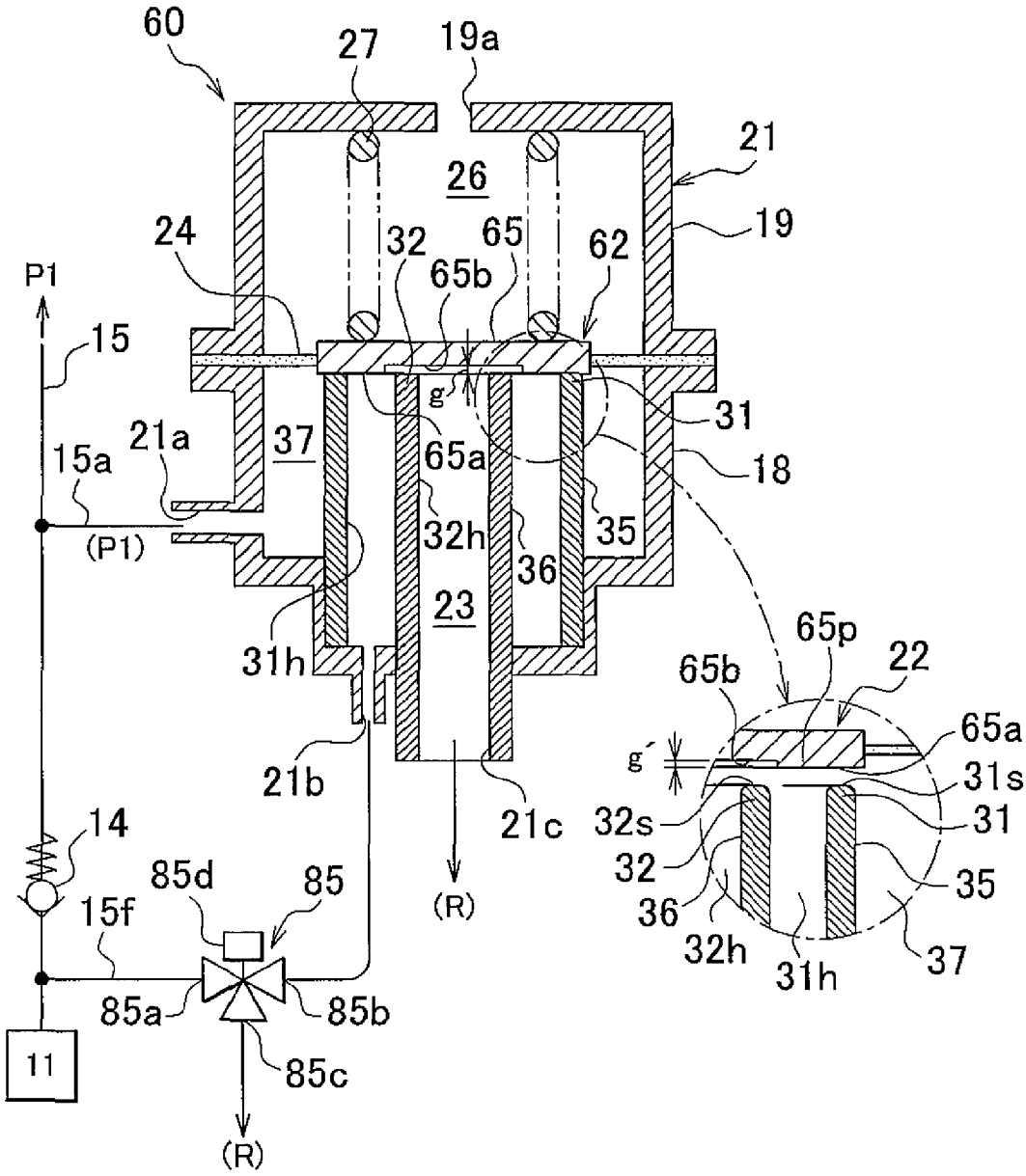
FIG. 17 is a block diagram schematically showing a fluid pressure regulating device according to an eleventh example embodiment of the invention.

As shown in FIG. 17, a fluid pressure regulating device and a fuel supply system using this fluid pressure regulating device according to an eleventh example embodiment use a three-way electromagnetic valve 85 instead of the electromagnetic valve 45 as in the third example embodiment shown in FIGS. 7 and 8. In addition to the effects of the third example embodiment, in this example embodiment, just as in the ninth example embodiment, when the pressure regulator 60 is set to a low pressure, the outflow amount of pilot pressure fuel is suppressed, thereby enabling the load on the fuel pump 11 to be reduced, and when the pressure regulator 60 is set to a high pressure, fuel within the middle fuel passage 31*h* can be quickly discharged, and thus the pilot pressure can be quickly released, thus improving the responsiveness of a fuel pressure switch.

Figure 18:
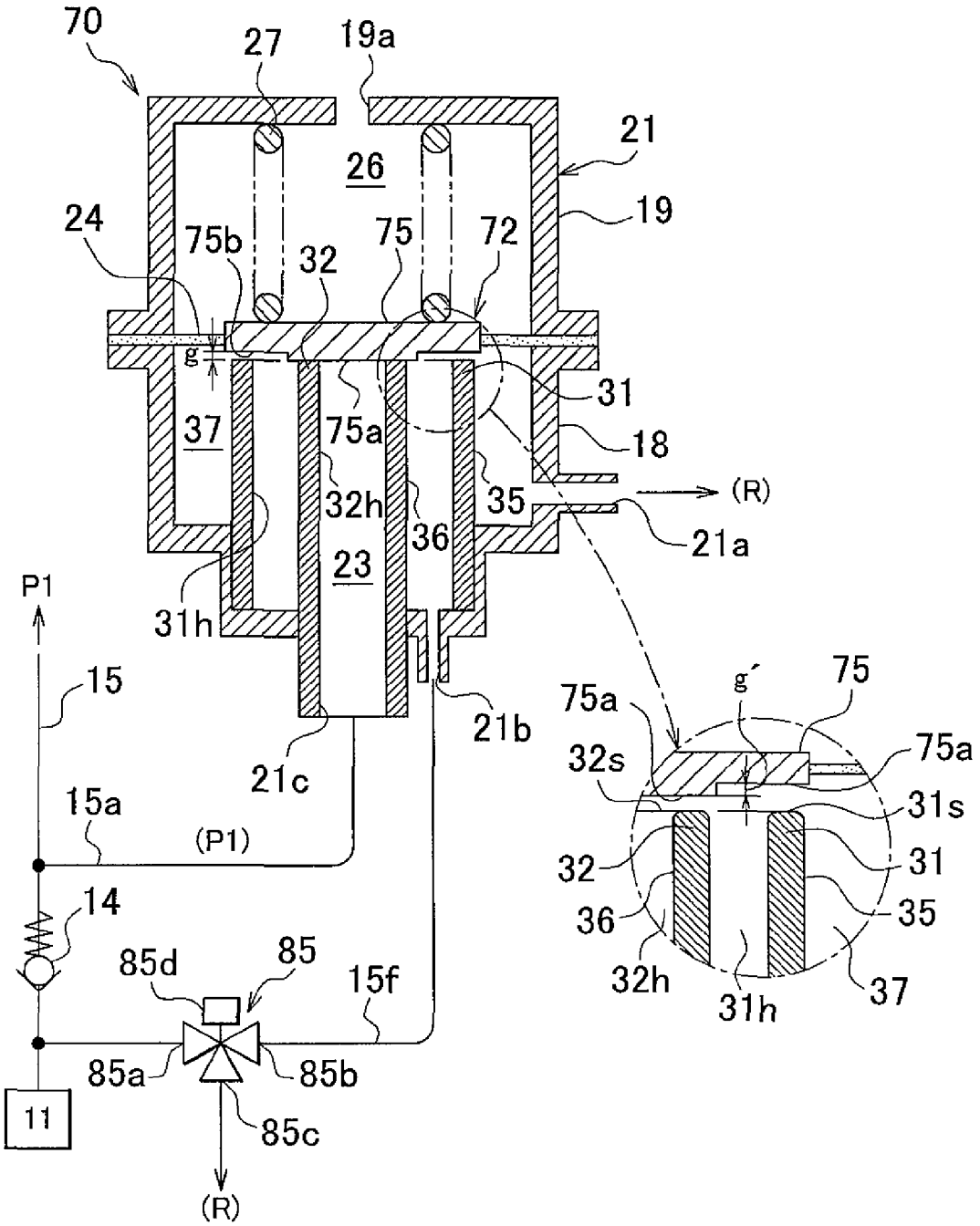
FIG. 18 is a block diagram schematically showing a fluid pressure regulating device according to a twelfth example embodiment of the invention.

As shown in FIG. 18, a fluid pressure regulating device and a fuel supply system using this fluid pressure regulating device according to a twelfth example embodiment use a three-way electromagnetic valve 85 instead of the electromagnetic valve 45 as in the fourth example embodiment shown in FIGS. 9 and 10. In addition to the effects of the fourth example embodiment, in this example embodiment, just as in the ninth example embodiment, when the pressure regulator 70 is set to a low pressure, the outflow amount of pilot pressure fuel is suppressed, thereby enabling the load on the fuel pump 11 to be reduced, and when the pressure regulator 70 is set to a high pressure, fuel within the middle fuel passage 31*h* can be quickly discharged, and thus the pilot pressure can be quickly released, thus improving the responsiveness of a fuel pressure switch.

Incidentally, other than the example embodiments described above, it is possible to selectively restrict, using a discharge switching valve, only the discharge of the pilot pressure fuel from the fuel passage into which the pilot pressure fuel is introduced, from among the plurality of fuel passages in the pressure regulating chamber 23. However, it is preferable to use a three-way valve such as in the ninth to the twelfth example embodiments in order to suppress the amount of return fuel when the set pressure is a low set pressure.

Also, in the first example embodiment, the pressure regulating chamber 23 is divided into three fuel passages (fluid passages) by the first and second annular valve seat portions 31 and 32, i.e., the plurality of valve seat portions. However, in the invention, it is also possible to provide three or more fuel passages using multiple valve seat portions, and provide three or more corresponding pressure receiving portions on the pressure regulating member. That is, in the invention, the first valve seat portion and the second valve seat portion refer to two valve seat portions, from among a plurality of valve seat portions, with different set clearances. A structure that includes multiple valve seats that include a third valve seat may also be used. Also, one or both of the pressure receiving portions of the pressure regulating member 22 that correspond to the fuel introduction side fluid passage and the fuel discharge side fluid passage may be divided into a plurality of pressure receiving portions.

Also, the pressure regulating member 22 in the first example embodiment described above has the flexible annular membrane member 24 and the plate-shaped member 25. However, the annular membrane member 24 may be shaped like a piston that is slidably retained inside the housing 21, and may support the back surface of the plate-shaped member 25.

Furthermore, the first example embodiment described above describes an in-tank type fluid pressure regulating device and a fuel supply system that uses this in-tank type fluid pressure regulating device. However, the fluid pressure regulating device may of course also be arranged near a delivery pipe. Also, the outer cylindrical member 35 and the inner cylindrical member 36 are produced separate from the housing 21, and then fixed to the housing 21. However, the outer cylindrical member 35 and the inner cylindrical member 36 may of course also be integrally molded with the housing 21.

Also, in the first example embodiment described above, the back pressure chamber 26 side opens into the fuel tank 2. However, a closed back pressure chamber may be formed on the other side of the pressure regulating member 22 inside the housing 21, and other compressed fluid (such as air) of negative pressure or positive pressure may be sealed in this closed back pressure chamber, or fluid for applying back pressure may be supplied to and discharged from this closed back pressure chamber by a special back pressure supply circuit.

Furthermore, in the first example embodiment described above, the fuel consuming portion is a gasoline engine for a vehicle that consumes gasoline, but the fuel consuming portion may of course also be an engine that uses other fuel, and the invention may also be applied to an engine other than an engine for a vehicle. Also, the invention may be applied to a case in which switching between a high fuel pressure and a low fuel pressure is performed in any of a variety of fuel consuming portions that produce some sort of output by burning fuel.

As described above, the invention changes the pressure receiving area of the pressure regulating member by controlling the inflow and outflow of fluid with only one side of the pressure regulating member, and provides the housing with the first valve seat portion and the second valve seat portion that have different clearances with respect to the pressure regulating member to ensure the sealability at one valve seat portion that separates the fluid introduction side fluid passage from the fluid discharge side fluid passage. As a result, a low cost fluid pressure regulating device that is capable of stably regulating fluid pressure and maintaining that pressure regulating value, and that is suitable for switching a set pressure, and that is compact due to a simple passage configuration, can be provided. Moreover, a low cost fuel supply system in which, owing this fluid pressure regulating device, fluid pressure can be stably regulated and that pressure regulating value can be maintained, and that is suitable for switching a set pressure, and that is compact due to a simple passage configuration, can be provided. The invention is generally useful as a fluid pressure regulating device suited to regulating fuel pressure when fuel for an internal combustion engine is supplied from a fuel pump to a fuel injection valve, and as a fuel supply system that uses this fluid pressure regulating device.

While the invention has been described with reference to example embodiments thereof, it is to be understood that the invention is not limited to the described embodiments or constructions. To the contrary, the invention is intended to cover various modifications and equivalent arrangements. In addition, while the various elements of the example embodiments are shown in various combinations and configurations, other combinations and configurations, including more, less or only a single element, are also within the scope of the invention.

What is claimed is:

1. A fluid pressure regulating device is able to regulate the pressure of a fluid introduced into a fluid introduction side fluid passage to a set pressure that has been set beforehand, the fluid pressure regulating device comprising:

a housing that includes the fluid introduction side fluid passage into which fluid is introduced and a fluid discharge side fluid passage from which the fluid is discharged, a partition wall-shaped pressure regulating member that forms a pressure regulating chamber inside the housing, the pressure regulating chamber being communicated with the fluid introduction side fluid passage, and that communicates the fluid introduction side fluid passage with the fluid discharge side fluid passage according to a pressure of the fluid introduced into the pressure regulating chamber, and a first valve seat portion and a second valve seat portion that are provided in the housing, the first valve seat portion and the second valve seat portion separating the fluid introduction side fluid passage from the fluid discharge side fluid passage in the pressure regulating chamber, and forming another fluid passage inside the pressure regulating chamber, the other fluid passage being switched between being communicated with the fluid introduction side fluid passage and being communicated with the fluid discharge side fluid passage, by the pressure regulating member, wherein a clearance between the pressure regulating member and the first valve seat portion is set different from a clearance between the pressure regulating member and the second valve seat portion, such that when the pressure regulating member abuts against one valve seat portion, from among the first valve seat portion and the second valve seat portion, a small gap is formed between the other valve seat portion, from among the first valve seat portion and the second valve seat portion, and the pressure regulating member.

2. The fluid pressure regulating device according to claim 1, wherein the first valve seat portion forms the fluid introduction side fluid passage, and separates the fluid introduction side fluid passage from the fluid discharge side fluid passage; the second valve seat portion forms the fluid discharge side fluid passage, and forms the other fluid passage between the second valve seat portion and the first valve seat portion; and the small gap is formed between the pressure regulating member and the second valve seat portion when the pressure regulating member abuts against the first valve seat portion.

3. The fluid pressure regulating device according to claim 1, wherein the first valve seat portion and the second valve seat portion are concentrically arranged.

4. The fluid pressure regulating device according to claim 3, wherein the first valve seat portion is formed by an end portion of one of an outer cylindrical member or an inner cylindrical member, the second valve seat portion is formed by an end portion of the other of the outer cylindrical member or the inner cylindrical member, and the outer cylindrical member and the inner cylindrical member are arranged on the same axis.

5. The fluid pressure regulating device according to claim 4, wherein the first valve seat portion is formed by the end portion of the outer cylindrical member and the second valve seat portion is formed by the end portion of the inner cylindrical member.

6. The fluid pressure regulating device according to claim 1, wherein the pressure regulating member has a plate-shaped movable valve body portion that faces the first valve seat portion and the second valve seat portion; and the first valve seat portion and the second valve seat portion each have a valve seat surface that is parallel to one side portion of the movable valve body portion.

7. The fluid pressure regulating device according to claim 1, wherein the pressure regulating member has a plate-shaped movable valve body portion that faces the first valve seat portion and the second valve seat portion; and the movable valve body portion has an annular step on one side portion that faces the first valve seat portion and the second valve seat portion, and has a circular or annular convex portion that abuts against one valve seat portion, from among the first valve seat portion and the second valve seat portion.

8. The fluid pressure regulating device according to claim 1, wherein an area of a pressure receiving region of the pressure regulating member is changed by changing a pressure of the fluid inside the other fluid passage.

9. The fluid pressure regulating device according to claim 8, further comprising a set pressure switching valve that changes the pressure of the fluid inside the other fluid passage by selectively restricting introduction of the fluid into the other fluid passage or discharge of the fluid from the other fluid passage.

10. The fluid pressure regulating device according to claim 9, wherein the set pressure switching valve is formed by a three-way valve that changes the pressure of the fluid inside the other fluid passage by controlling the introduction of the fluid into the other fluid passage and the discharge of the fluid from the other fluid passage.

11. A fuel supply system comprising the fluid pressure regulating device according to claim 1, wherein a pressure of fuel supplied from a fuel pump to a fuel injection valve of an internal combustion engine is regulated by the fluid pressure regulating device.

* * * * *